US008939103B2

(12) United States Patent
Wong

(10) Patent No.: US 8,939,103 B2
(45) Date of Patent: Jan. 27, 2015

(54) DEPLOYABLE ASSEMBLY

(75) Inventor: Barnitus Alban Wong, Dearborn, MI (US)

(73) Assignee: Barnitus A. Wong, Farmington, MI (US)

( * ) Notice: Subject to any disclaimer, the term of this patent is extended or adjusted under 35 U.S.C. 154(b) by 183 days.

(21) Appl. No.: 12/879,836

(22) Filed: Sep. 10, 2010

(65) Prior Publication Data

US 2012/0060737 A1 Mar. 15, 2012

(51) Int. Cl.
*B63B 43/14* (2006.01)

(52) U.S. Cl.
USPC ..... 114/123; 114/39.28; 114/61.16

(58) Field of Classification Search
USPC ..... 114/123, 292, 343, 364, 39.23, 39.28, 114/61.11, 61.16
See application file for complete search history.

(56) References Cited

U.S. PATENT DOCUMENTS 2,678,018 A * 5/1954 Crisp ..... 114/123
3,276,413 A 10/1966 Dolph et al.
3,929,085 A * 12/1975 Mason ..... 114/123
4,457,248 A * 7/1984 Thurston ..... 114/123
6,305,306 B1 10/2001 Grzybowski
7,644,674 B1 1/2010 Goldston
7,650,847 B1 1/2010 Wicks et al.

OTHER PUBLICATIONS

Hobie Cat, 2010 Product catalog, Adventure Island kayak, pp. 20-21, Hobie Cat Company, Oceanside, CA, USA, hobiecat.com.

* cited by examiner

*Primary Examiner* — Lars A Olson

(57) ABSTRACT

This embodiment relates generally to the deployable assembly (30) for a suspended device (38), that may lead to the stabilization of a watercraft (32), such as kayaks and canoes, which allows an operator (134) to stand or move in the watercraft (32) without it rocking or rolling over. The deployable assembly with an example pontoon (112) connected to a folding and rotate-able arm (80) that enable pivotal and rotate-able movement of each pontoon between storage (128) and deployed positions. A locking housing (102) secures the pontoon (112) from substantial movement when at or in between operating and storable positions (128). The deployable assembly (30) is mounted to a watercraft (32) which allows for extending a stabilizing pontoon individually on each side of the watercraft from a rest position (128) to an operative position, by solo means.

20 Claims, 16 Drawing Sheets

80A
158B
160
158A
48A 80A
164
166
162
48A 80A
82
66
70A
68A
62
72
48A 19A
19B
19C
80A
48A
32
202
204
206
208
210
212
214
216
218
220
222
224
226
228
230

DEPLOYABLE ASSEMBLY

CROSS REFERENCE TO RELATED APPLICATIONS (IF APPLICABLE)

This application claims the benefit of PPA Ser. No. 67/241,139 filed on Sep. 10, 2009 by present inventor, which is incorporated by reference.

BACKGROUND

Prior Art

The following is a tabulation of some prior art that presently appears relevant:

| U.S. Patents | | | |
|---|---|---|---|
| Pat. No. | Kind Code | Issue Date | Patentee |
| 3,276,413 | | Oct. 4, 1966 | Dolph et al. |
| 7,650,847 | B1 | Jan. 26, 2010 | Wicks et al. |
| 7,644,674 | B1 | Jan. 12, 2010 | Goldston |
| 6,305,306 | B1 | Oct. 23, 2001 | Grzybowski |
| Non Patent Literature Documents | | | |
| HOBIE CAT, 2010 Product catalog, Adventure Island kayak, pages 20-21, Hobie Cat Company, Oceanside, CA, USA, hobiecat.com. | | | |

Fishing from a paddled watercraft, such as a canoe or kayak, have become popular activities. Such fishing presents many benefits, especially in small, shallow water locations, where stealth and a shallow draft are almost prerequisites to successfully fish these conditions. The paddled watercraft, having a relatively narrow width, typically not much wider than to necessitate two people exchanging places in a canoe version, is a very maneuverable craft and by its nature can be easily rolled from side to side. This is even made worse when the kayak version of the watercraft has a width are no wider than a person's shoulders. While the ability to easily roll the paddled craft may present benefits in certain paddling environments, the propensity to roll the paddled watercraft may be less beneficial when a relatively stable platform is desired in other watercraft environments, such as standing up and fishing.

Floats and pontoons positioned alongside a watercraft for stabilizing are old and well known in the art. Devices are presently available to address stabilization through the addition of floatation devices. In more recent times, these devices have been provided with clamping supports and allow floatation to be clamped to a paddled watercraft and are generally held on in a fixed extended position from the side of the watercraft. An occupant in the paddled watercraft, who can quickly tip or capsize, uses these devices to prevent sudden overbalance movement.

I have found that having fixed pontoons extended along sides causes parasitic drag that robs the paddler of distance and speed when watercraft movement is required. And I have also found that when the watercraft is powered by a motor, enabling the watercraft to reach higher speeds that necessitates banking at an angle during turns, these fixed pontoons, at best, prevents the watercraft from banking during a turn. But worst still, performing any such banking submerges the inside turn pontoon, causing it to dive further underwater, capsizing the watercraft.

Thus it is advantageous to have a pontoon system that lifts out of the water high enough for banking at motored speeds, and then to rapidly extend the floatation device as needed to stabilize the watercraft under fishing-while-standing conditions, or when moving around in the watercraft.

Additionally, it is also advantageous to have this operation performed solo from the back of the boat. This is particularly useful as I often fish alone while controlling a stern mounted outboard motor controlled by a short control arm. Therefore, the ability to deploy the pontoon system from this stern location will save me additional movement and steps, added movement that may cause the watercraft to tip before the stabilization system is in place.

Additionally, it would be advantageous that the pontoon, when fully lifted out of the water and stowed inside, still allows an occupant to sit comfortably in between the pontoons from each side. Even better is when this stowed position does not interfere with the operations of any accessories such as a rowing rig that makes it possible to row rather than to paddle the canoe drag free.

Due to the lightweight, plastic nature, and low torsional stiffness of canoes, I have found most canoes do not resist a longitudinal torsion stress well. This torsion stress is a result of a two people standing at the opposite ends of the canoe, fishing, but leaning laterally in the opposite direction. Thus, a singular floatation setup in the middle of the boat, or even one placed closer towards one of these fishermen, does not serve both fishermen well enough to counteract their imbalance. This is because the attachment point for a singular floatation system is too far from the stress source from either one or both standing fishermen. And that the resulting torsional flex from such distance causes a loss of stabilization response. Thus, I have also found that, for canoes, an elongated pontoon system attached to the canoe using two or so attachment points, attachment points now closer to each stress point, provide superior stabilization than a short pontoon system connected at one point.

An additional benefit to having an elongated pontoon system is that its cross section profile is smaller than a short pontoon system of equivalent buoyancy, allowing it to more easily fit inside the canoe. This slimmer profile is particularly useful as the outriggers can be stowed inside the canoe without being detached from the stabilizer system, saving setup and breakdown time. Also, this inside stowing arrangement does not add to the canoe frontal profile, and does not impede with a relatively flat gunwale surface that allows mounting canoe on top of a car roof top carrier. All these benefits minimize air drag during transport, saving gas mileage, as well as the benefit of occupying about the same storage space as a virgin canoe. This elongated pontoon also provides the option of using an increased buoyancy, yet remaining able to still fit inside the canoe without the cited interference issues.

Another problem I encountered is the ability to navigate in tight sections of a river where safe and full passage is not possible if the stabilization system were fully extended. This narrow river condition would require the advantage of a temporary and quick change to the watercraft's total width, stabilization included, that is quickly operable from the rear of the boat, and by solo means. Additionally, it would also be advantageous to maintain the benefit of the pontoons remaining in continuous contact with the water, even under a reduced stabilization, while traveling under such narrow width that necessitates this extra stabilization.

Another problem is climbing into a canoe from a pier or from dry land. If the pontoons require a big step into the boat, it creates the likelihood of the climber loosing balance, adding to the possibility of tipping the entire canoe during entry.

Another problem I encountered is keeping the stabilization system lightweight, economical, and easy to manufacture. Trailering a watercraft with the weight of an elongated pontoon hanging either side of the watercraft—without directly supporting the pontoons from underneath—puts tremendous road bounce stress onto the stabilization system's components. This drives up the required strength of the stabilization system above and beyond what is required for it's on-water use, driving up cost, weight, bulk, and complexity of design. Thus, it would be advantageous to support an elongated pontoon inside or outside the canoe, taking out the need to design in trailer and stowage stress from the stabilization system.

The stabilization system in U.S. Pat. No. 7,650,847 to Wicks et al, 2006 Jan. 26, only shows it's use for one short flotation, a limitation cited above in regard to the torsional flex causing a loss of stabilization response. And even if two of Wicks systems were in place to be used with an elongated float, this arrangement would not allow a person operating a stern mounted motor to operate both stabilization systems without having to first move to a midpoint location between such systems for deployment. This prerequisite movement to reach both deploying handles of the same side increases the likelihood for the watercraft to tip before the stabilization system can be in place. The Wicks embodiment does not support an elongated pontoon directly from underneath, especially in stowage position, which does not relieve the stabilization system from road bounce stress. Additionally, the Wicks system does not allow continuos pontoon contact with the water when necessitating a narrow profile for tight sections of a river. Also, it creates a large step into the canoe especially when in use with an elongated canoe.

The stabilization system in FIG. 1, U.S. Pat. No. 6,305,306 to Grzybowski, 2001 Oct. 23, shows it's use for one short flotation, sharing the same limitations as with Wicks in regards to torsional flex that causes a loss of stabilization response. Additionally, the Grzybowski embodiment does not allow a flat gunwale surface required for a flat fold design, as stowage of pontoon inside the canoe is not possible with this patent. Additionally, the Grzybowski embodiment does not allow continuos pontoon contact with the water when necessitating a narrow profile for tight sections of a river. Additionally, the support member 200 outside the hinge 220, that flips up onto itself, is restricted in its length. If this support member 200 is too long, it will prevent the comfortable seating of an occupant between two flipped up pontoons from both sides. This restriction is even made worse when used in tandem with a duplicate embodiment for an elongated pontoon. But more importantly, this length restriction in support member 200 interferes with a predetermined length required to get a meaningful resistance to roll. Additionally, it creates a climb over the pontoon in getting into a canoe, especially when in use with a elongated pontoon, increasing the likelihood of tipping during entry.

The stabilization embodiment in FIGS. 2 and 3, U.S. Pat. No. 3,276,413 to Dolph et al., 1966 Oct. 4, also shares Wicks' limitation that prevents operating the stabilization embodiment from the rear of boat by solo means. This is because the operator has to move within operating distance to disengage pins 26, and that travel is made longer to reach the pin 26 on a bow connection for long pontoons. Additionally, the Dolph embodiment permanently maintains the float in the water, inducing a permanent drag, and does it have any vertical pontoon adjustment. The Dolph embodiment also does not anticipate a flip up of the floats from when they are positioned next to the watercraft, shown in FIG. 2, to inside the canoe. This absence is supported by the detents 33 and springs 31 preventing the tubular members from easily rotating during a flip up maneuver. But even more fatally, the needed clearance to perform such maneuver is not present in the embodiment. The swinging clearance in FIG. 3, a clearance defined by the centerline of member 30 to the top of float 10', does not clear the required clearance between pivot 25 and the most outboard edge of web 23. The absence of an alternate embodiment for this clearance reinforces this limitation. Additionally, the detent holes for pin 26 do not allow an elongated pontoon to touch the side of the canoe, so as to reduce the climb over step into the canoe.

The stabilization embodiment in FIGS. 4 and 5, U.S. Pat. No. 7,644,674 to Goldston, 2010 Jan. 12, shows that its stabilizing properties, driven by the length of it's stabilizing arm, is heavily constrained in order for the outrigger 19 to fit inside the hull 11. This stabilizing arm, as measured from where hinge plate 26 protrudes beyond gunwale 14 to centerline of outrigger 19, must be shorter than the vertical depth of the hull 11. Because most paddled watercrafts have relatively shallow hull vertical depth, the resulting stabilizing arm is not meaningful in length so as to provide adequate stabilizing to the canoes or kayaks. This is even made worse when most Sit-On-Top Kayaks have no vertical hull depth. Also, the Goldston embodiment suffers the same torsional limitation mentioned previously. Goldston's embodiment also requires an operator's movement away from the rear boat area to unlock pins 30, increasing the likelihood of tipping before securing the pontoons. Goldston's embodiment also requires the sidewalls of hull 11 to be flat for plate 21 to secure to and for outrigger 19 to fit inside, a sidewall feature not present in paddled watercrafts due to their tapered nature for minimal drag. Additionally, the swing clearance 37 takes up such large clearance that it would not be possible to swing both left and right outriggers into the stowage position in a canoe with an occupant sitting between them. This swing clearance is a distance measured in a direct line between hinge pin 29 and a pontoon 19 surface radially furthest from this hinge pin. Additionally, the step over into the watercraft increases the risk of entering thereof since the outrigger 19 and plate 21 are in the way, whether in stowed or deployed position.

The stabilization system for the Hobie Cat's Adventure Island kayak shares the same limitation as Dolph's embodiment in maintaining the float permanently in the water, inducing a permanent drag. Additionally, Hobie's embodiment does not have any vertical pontoon adjustment. It also does not flip up the floats from when they are adjacent to the watercraft, causing extraordinary stress on the supporting system during trailing. This stress is high enough that a special cradle device is needed to support these pontoons (HOBIE CAT, 2009-10 Parts and Accessories catalog, Hobie/Trailex Aluminum trailers for Kayak, page 25, Hobie Cat Company, Oceanside, Calif., USA, hobiecat.com; not cited in Invention Disclosure Statement since cradle device is a counter-measure to a relevant art).

In accordance with one embodiment, the present embodiment, on the other hand, is directed primarily to watercraft, such as a canoe or kayak, and town outrigger floatation embodiment which is in a raised or storage position while paddling or motoring the canoe or kayak and which can be rapidly extended to add stabilization to the watercraft so that the occupant can stand for fishing or doing other functions without the watercraft tipping over and capsizing. A pontoon can be extended from one or both sides, as desired.

ADVANTAGES

Accordingly several advantages of one or more aspects are as follows: to have a pontoon system that lifts out of the water high enough for banking at motored speeds, and then to rapidly extend the floatation device as needed to stabilize the watercraft prior to and while under fishing-while-standing conditions, or when moving around in the watercraft; that can be deployed by solo means from one end of the watercraft; that still allows an occupant to sit comfortably in between the pontoons when pontoons are fully lifted out of the water and stowed inside; that this pontoon stowed position does not interfere with the operations of any accessories such as a rowing rig that makes it possible to row rather than to paddle the canoe without pontoon drag; that can employ an elongated pontoon system that attaches the pontoon to the canoe at two or more attachment points, attachment points close to each stress points; that can stow inside the canoe and not substantially add to the canoe frontal profile; that does not impede with a relatively flat gunwale surface to mount on top of a car roof top carrier; that allows larger elongated pontoons to stow inside the watercraft side walls in an unobtrusive manner; that allows a quick change in the watercraft's total width, stabilization included, that is quickly operable from the rear of the boat and by solo means; that can maintain the benefit of the pontoons remaining in continuous contact with the water, even under a reduced stabilization, while traveling under a narrow river width that necessitates extra stabilization; that allows easy access in and out of a watercraft; and that supports an elongated pontoon directly without detaching from the stabilization system, taking out the need to design in trailer and stowage stress into the stabilization system, reducing cost, weight, bulk, and complexity of design. Other advantages of one or more aspects will be apparent from a consideration of the drawings and ensuing description.

DRAWINGS

Figures

Notice:

A portion of the disclosure of this patent document contains material that is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

ALTERNATE EMBODIMENTS

Figures 8, 8A, 8B:
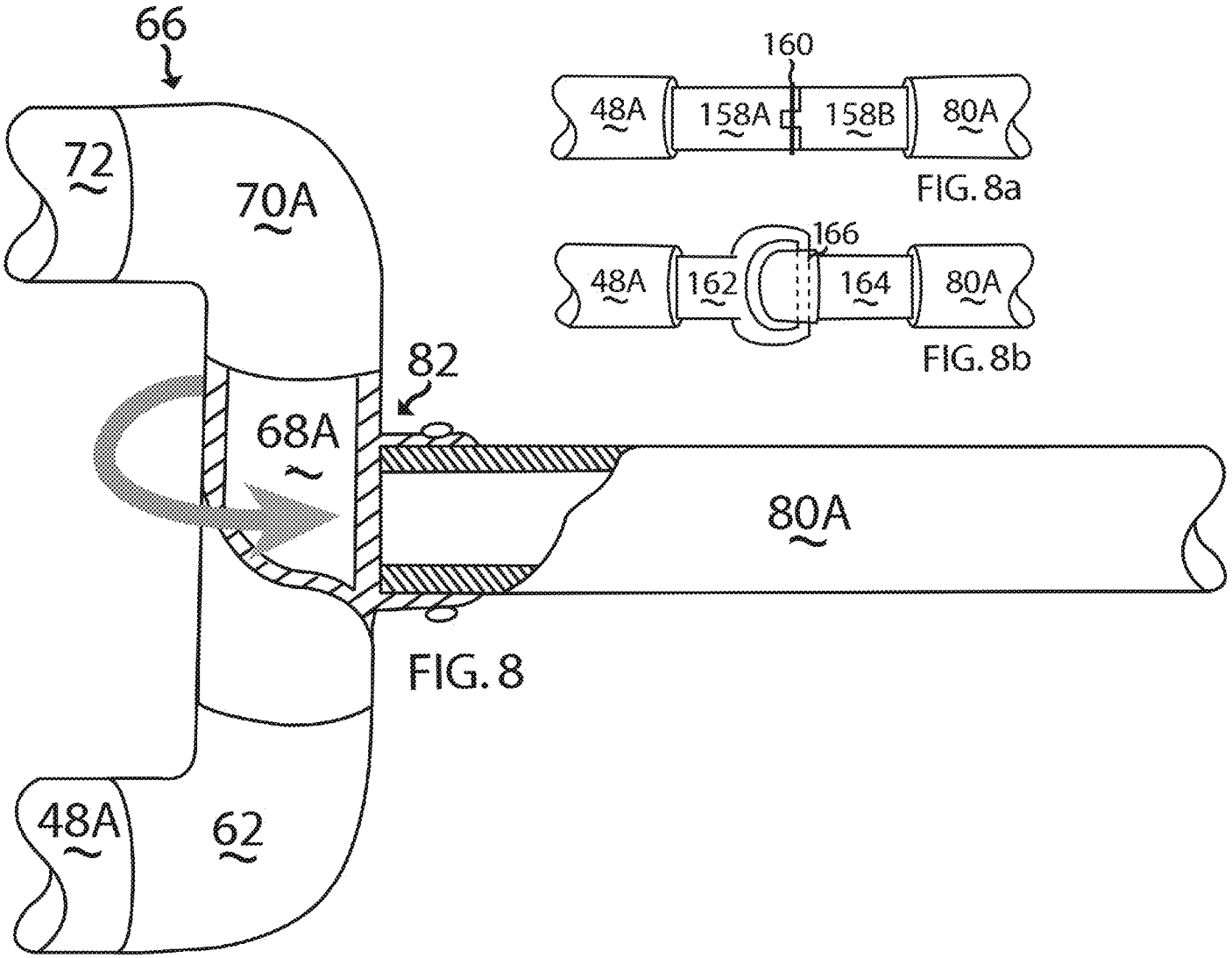
FIG. 8 shows a frontal view of an arm pivot connection to a D configuration setup.

FIG. 8A shows a front view of an alternate hinge arm connection to base member.

FIG. 8B shows a front view of an alternate yoke arm connection to base member.

FIG. 10A shows an isometric rear view of an alternative embodiment of urging member connection to an arm.

Figures 11, 11A:
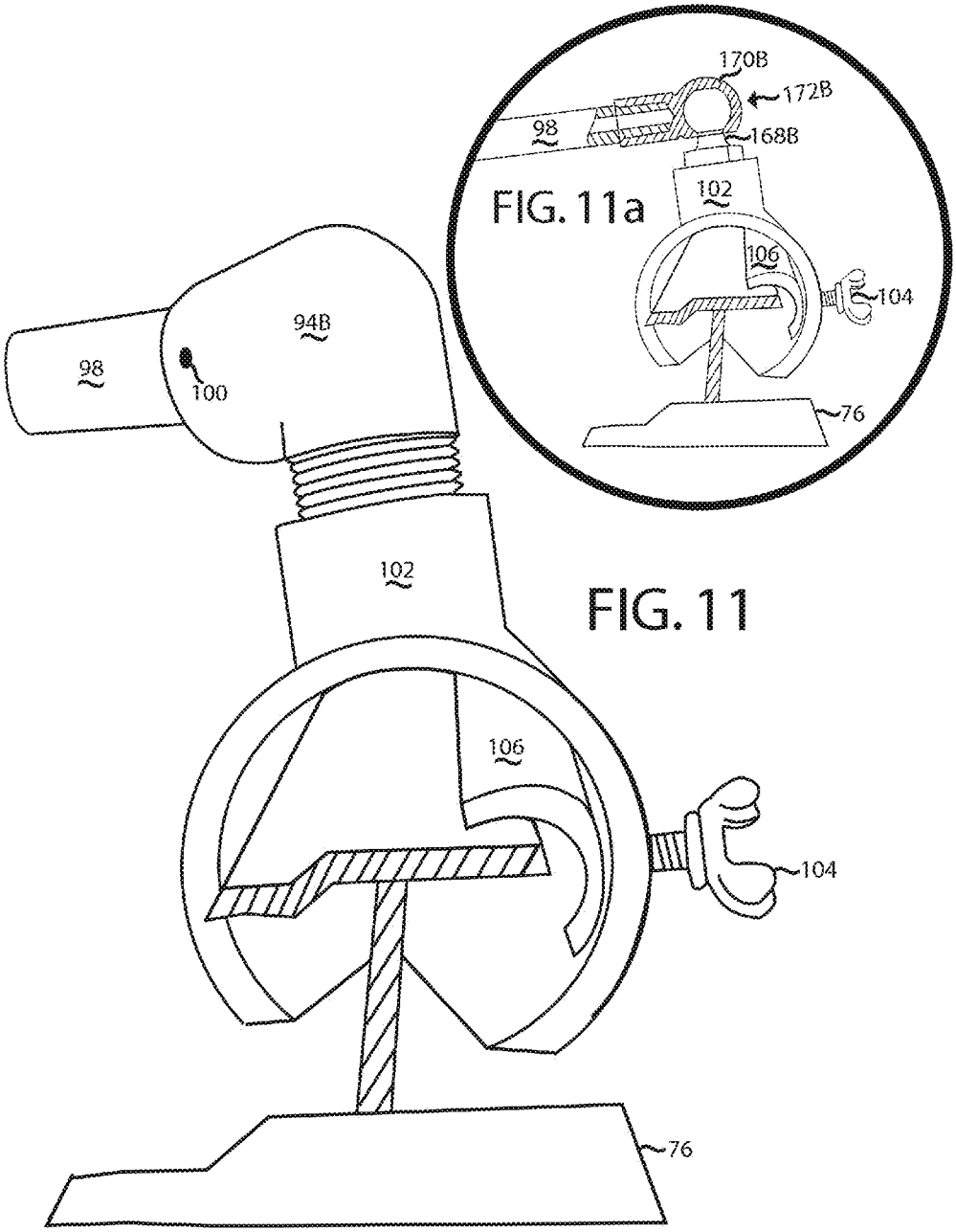
FIG. 11 shows an isometric rear view of an urging member attachment to a housing, and housing connection to gunwale.

FIG. 11A shows an isometric rear view of an alternative embodiment of an urging member attachment to a housing, and housing attachment to gunwale.

Figures 13, 13A:
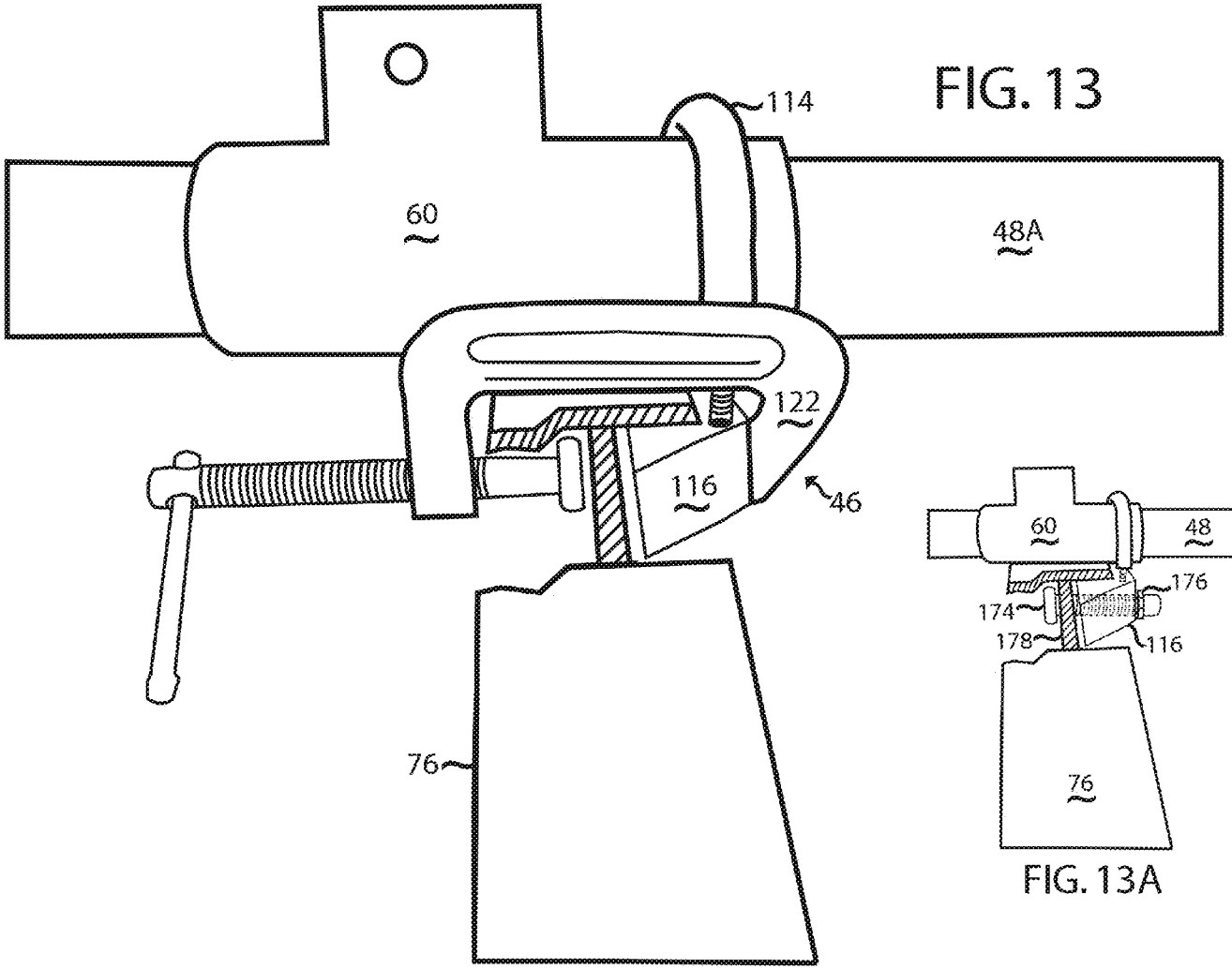
FIG. 13 shows a rear view of embodiment attachment to watercraft gunwale, using a attachment method of wood block, U bolt, and C clamp.

FIG. 13A shows an isometric rear view of an alternative embodiment of attaching deployable assembly to watercraft gunwale.

Figures 19, 19A, 19B, 19C:
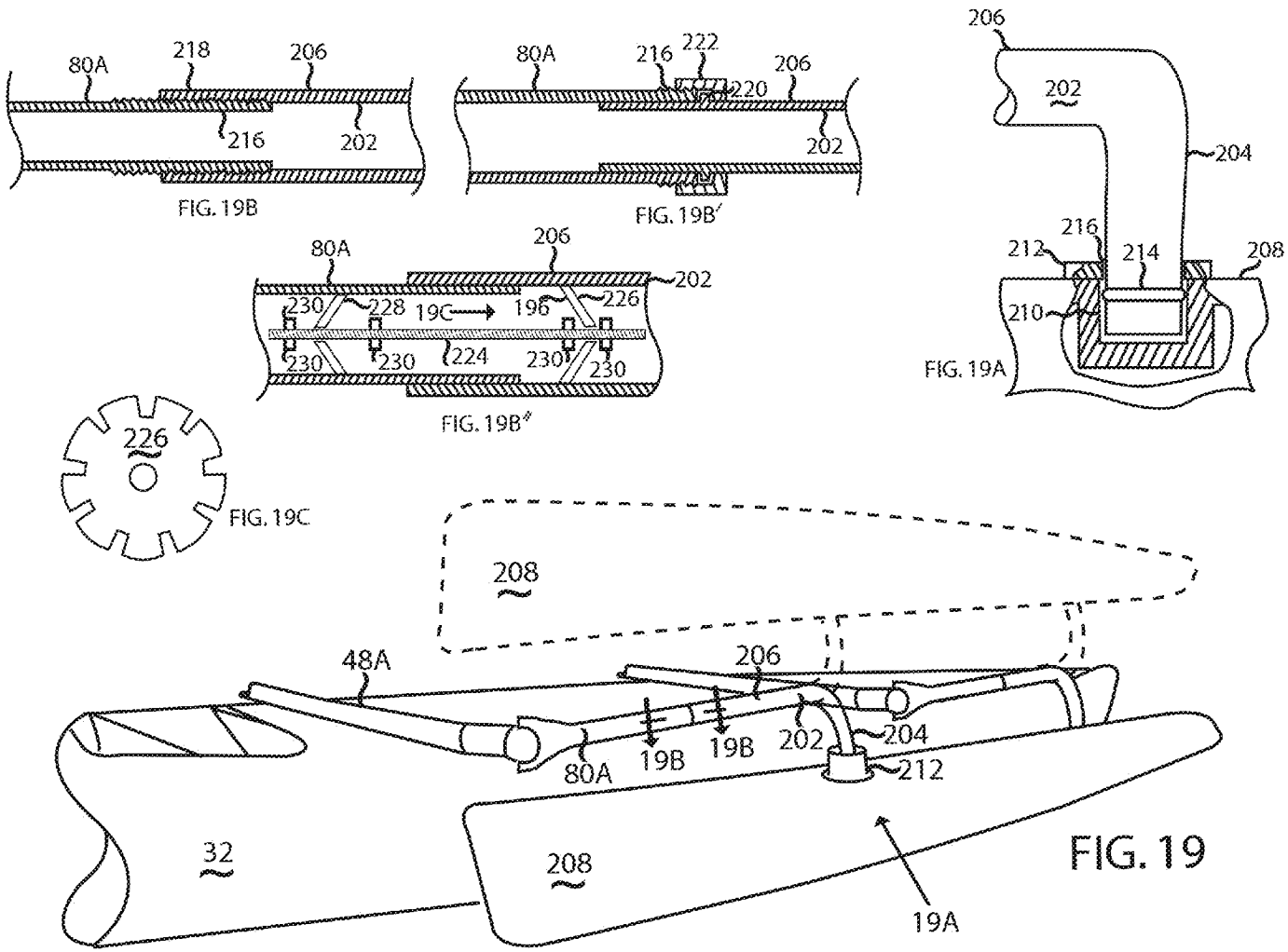

FIG. 19 shows an isometric side view of an alternate embodiment for vertical leg that is bent, and it's operation.

FIG. 19A shows a side view of an alternate embodiment for vertical leg connection to suspended device with recess.

FIG. 19B shows a side view cut section showing first alternative embodiment for connecting arm to arm portion of vertical leg.

FIG. 19B' shows a side view cut section showing second alternative embodiment for connecting arm to arm portion of vertical leg.

FIG. 19B" shows a side view cut section showing third alternative embodiment for connecting arm to arm portion of vertical leg.

FIG. 19 C shows a front view of a spreader nut.

Figure 20:
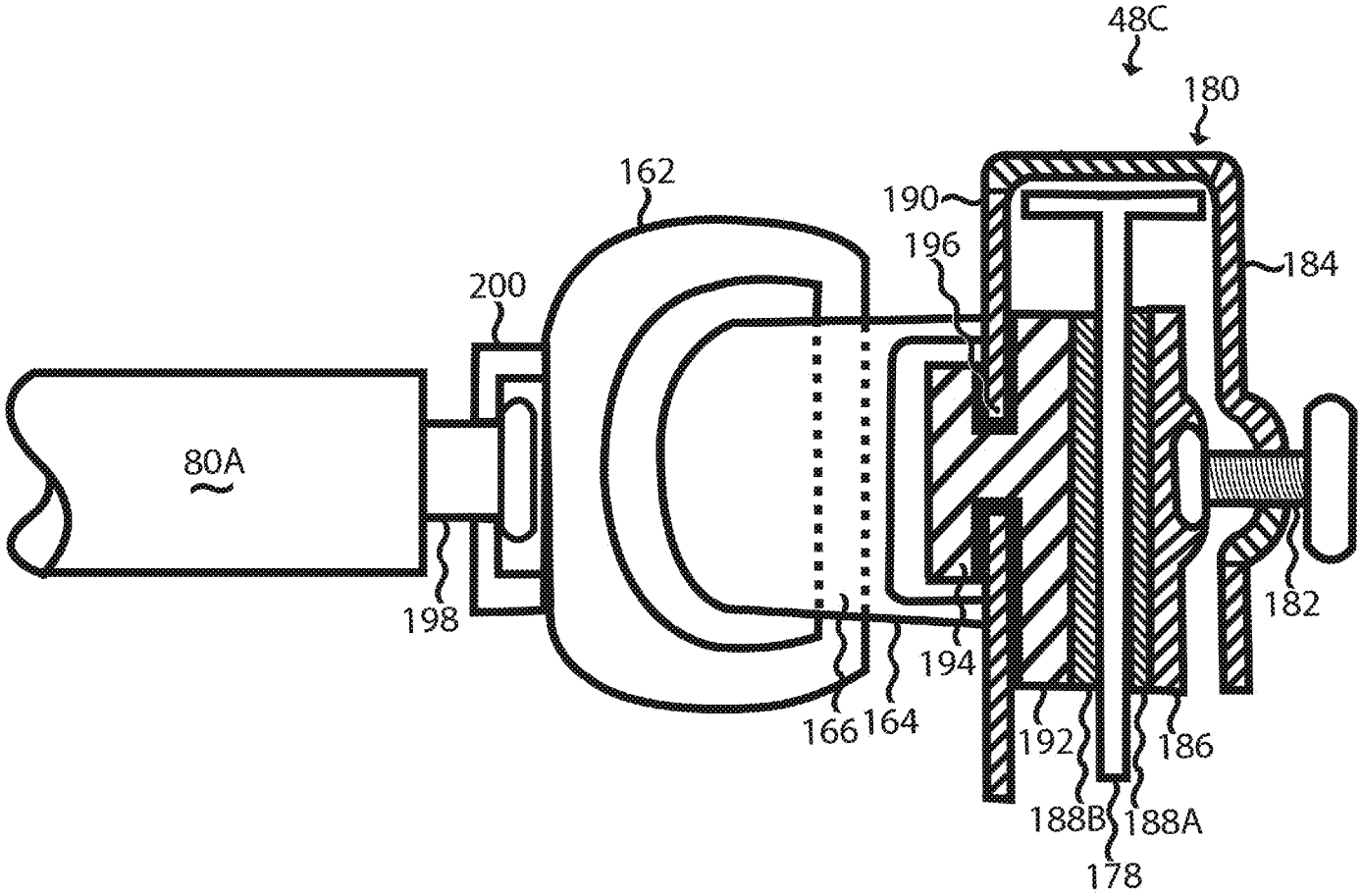

FIG. 20 shows an rear view of an alternative embodiment of attaching deployable assembly to watercraft gunwale, consisting of a pivot, a stud, and clamp.

Drawings- Reference Numerals

| | | | |
|---|---|---|---|
| 30 | Deployable assembly | 32 | Watercraft |
| 34 | Base foundation | 36 | Outrigger |
| 38 | Suspended member | 39 | Elongated pontoon setup |
| 40 | Deployment system | 42 | Front Setup |
| 44 | Rear Setup | 46 | Gunwale connection |
| 48 | Front(A) and Rear(B) base member | 48 | C Second base member |
| 50 | Support arm | 52 | Front(A) and Rear(B) first tee fitting |
| 54 | Front(A) and Rear(B) first pin | 56 | Watercraft spine |
| 58 | Foot | 60 | Second tee fitting |
| 62 | End fitting | 64 | Second Pin |
| 66 | D shape configuration | 68 | Front(A) and Rear(B) vertical member |
| 70 | 90 degree fitting | 72 | Horizontal member |
| 74 | Angled member | 76 | Gunwale |
| 78 | First(A) and Second(B) 45 degree fitting | 80 | Front(A) and Rear(B) Arm |
| 82 | Arm fitting | 84 | Front(A) and Rear(B) vertical leg |
| 86 | Front(A) and Rear(B) threaded fitting | 88 | Front(A) and Rear(B) threaded tee fitting |
| 90 | Fixed ring | 92 | End can |
| 94 | First(A) and Second(B) rotating fitting | 96 | Threaded tee fitting |

-continued

| Drawings- Reference Numerals | | | |
|---|---|---|---|
| 98 | Urging member | 100 | Tension pin |
| 102 | Housing | 104 | Wingnut |
| 106 | Shim | 108 | Front(A) and Rear(B) pontoon leg |
| 110 | Front(A) and Rear(B) third pin | 112 | Left(A) and Right(B) Pontoon |
| 114 | U bolt | 116 | Wood block |
| 118 | U bolt wingnuts | 120 | Spreader plate. |
| 122 | C clamp | 124 | Deck surface |
| 126 | Clamp | | |
| 127 | Fourth Pin | 128 | Inside stowed position |
| 130 | Adjacent to watercraft position | 132 | Body of Water |
| 134 | Operator | 136 | Rearward end of pontoon |
| 138 | Pontoon rearward position | 140 | Narrow Profile |
| 142 | Fold Flat state | 144 | Bungee cord |
| 146 | Underside of watercraft | 148 | Touching condition |
| 150 | Front left Pontoon leg | 152 | Outside pontoon support arrangement |
| 154 | Rowing Rig | 156 | Left(A) and Right(B) oars |
| 158 | Left(A) and Right(B) Hinge plate | 160 | Hinge Pin |
| 162 | Outside yoke | 164 | Inside yoke |
| 166 | Yoke Pin | 168 | Front(A) and Rear(B) Ball stud |
| 170 | Front(A) and Rear(B) Socket end | 172 | Front(A) and Rear(B) Ball and Socket joint |
| 174 | Gunwale bolt | 176 | Gunwale Nut |
| 178 | Vertical gunwale wall | 180 | U shaped clip |
| 182 | Clamp screw | 184 | Interior side |
| 186 | Pressure plate | 188 | Interior(A) and Exterior(B) non slip material |
| 190 | Exterior side | 192 | Exterior pressure plate |
| 194 | Keyed feature | 196 | Key hole feature |
| 198 | Swivel stud | 200 | Pocket |
| 202 | Second vertical leg | 204 | Down standing leg |
| 206 | Arm portion | 208 | Suspended member with recess |
| 210 | Recess | 212 | Cap |
| 214 | Raised ring feature | 216 | Outside threaded end |
| 218 | Inside threaded end | 220 | Second raised ring feature |
| 222 | Threaded housing | 224 | threaded member |
| 226 | First spreader nut | 228 | Second spreader nut |
| 230 | Blocking device | | |

DETAILED DESCRIPTION

First Embodiment

FIGS. 6 to 18

Figure 1:
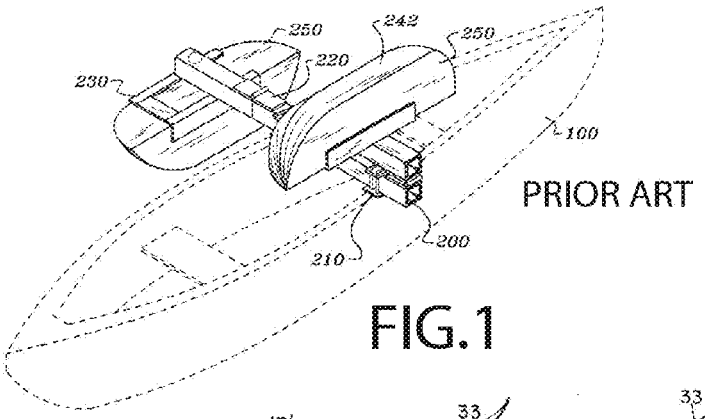
FIG. 1 is Prior Art, Grzybowski's embodiment.
Figure 2:
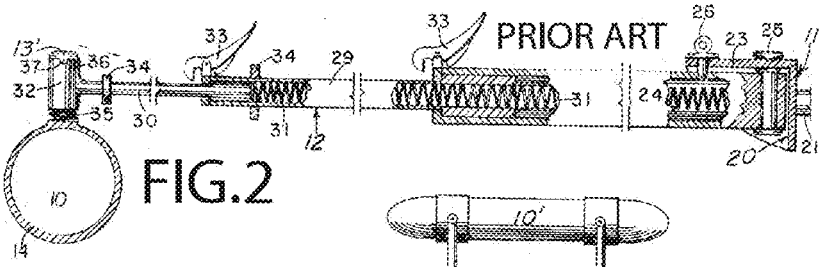
FIGS. 2 and 3 are Prior Art, Dolph's embodiments.
Figure 3:
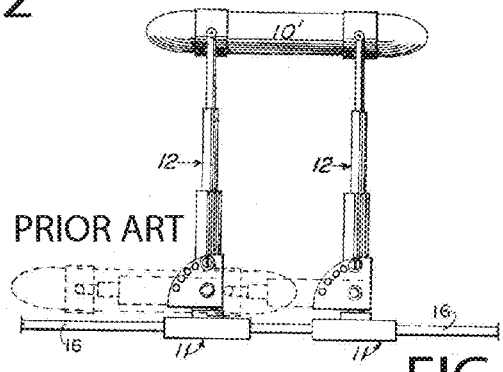
Figure 4:
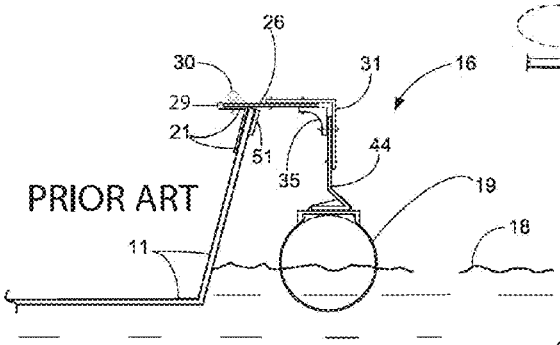
FIGS. 4 and 5 are Prior Art, Goldston's embodiments.
Figure 5:
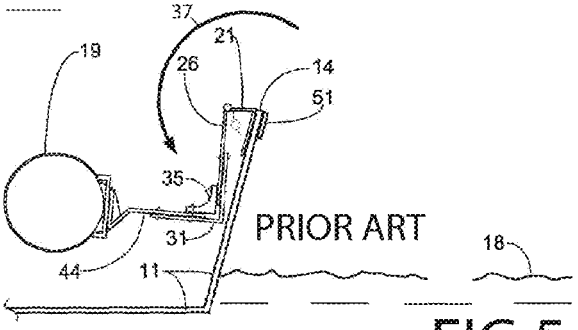
Figure 6:
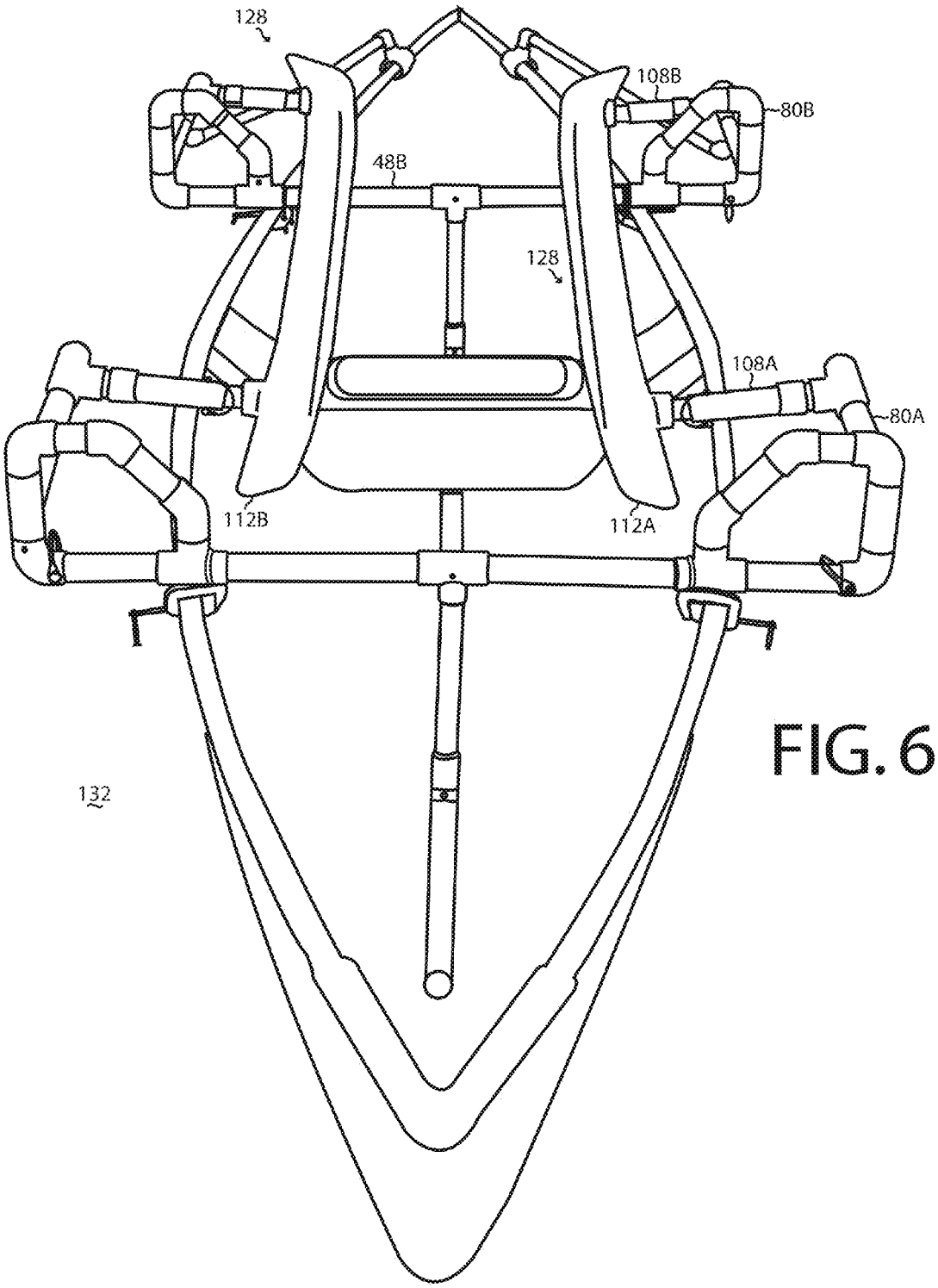
FIG. 6 shows an isometric frontal view of embodiment in stowed position.
Figure 7:
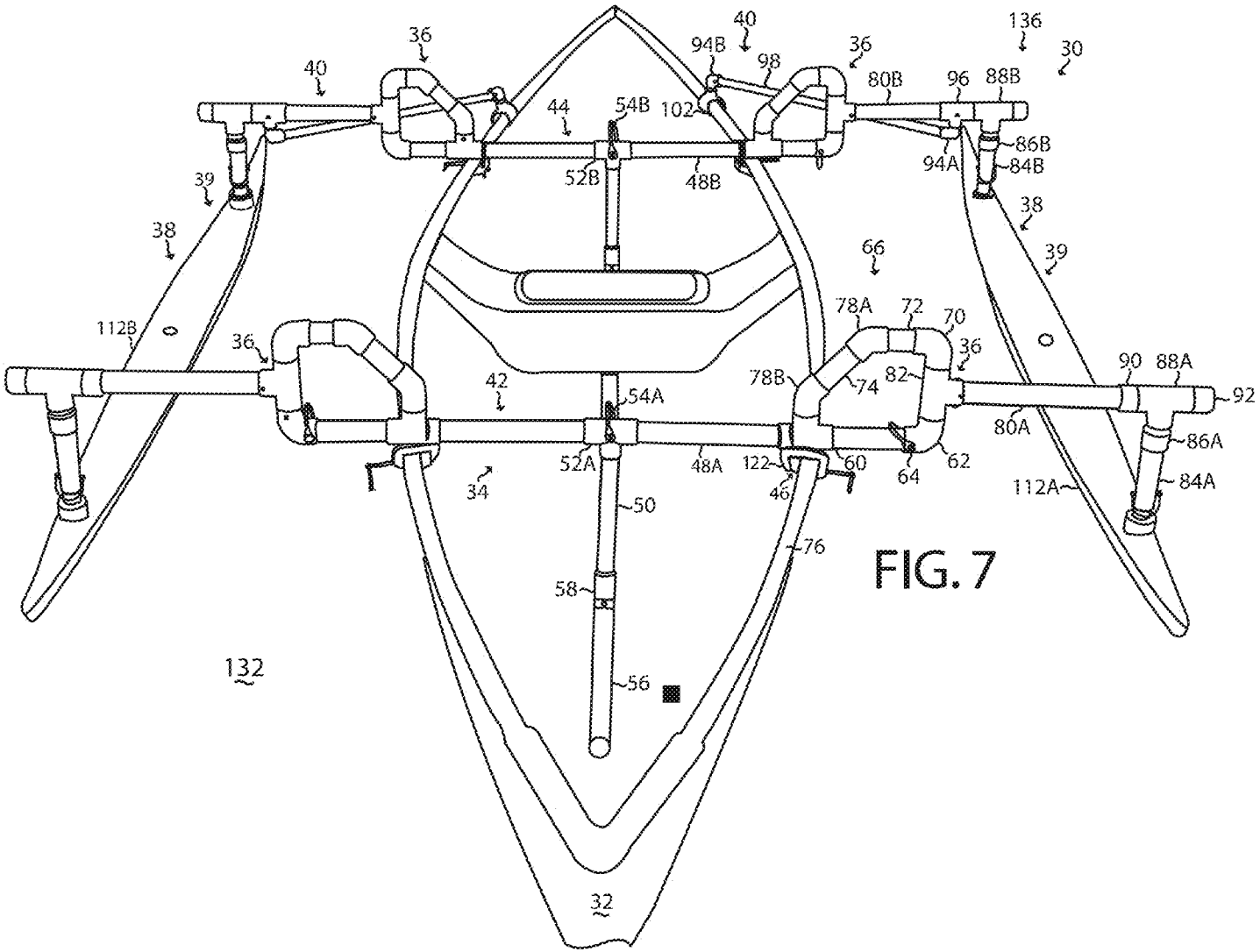
FIG. 7 shows an isometric frontal view of embodiment in deployed position.

With reference to the drawings FIGS. 6 to 18 but better shown in FIG. 7, a deployable device 30 mounted to a watercraft 32 is illustrated. The deployable device 30 comprises mainly of a base foundation 34, an outrigger 36 affixed at both ends of a base foundation 34, a suspended member 38 affixed to the outriggers 36, and a deployment system 40 affixed to the outriggers 36. Shown here as an example to the suspended member 38 is an elongated flotation setup 39 that requires a dual outrigger setup, with a front setup 42 different than a rear setup 44 by not having the deployment system 40. The preference for the location of the rear setup 44 is in the reaching proximity a solo operator confined to an area of the watercraft 32 that requires a convenient and safe boat operations, such as controlling an rear mounted outboard motor. Both the front 42 and rear 44 setups are joined by the flotation device 39. A short flotation system only requires a single outrigger setup, i.e. the rear 44 setup. Both setups 42 and 44 are mounted to the watercraft 32 by a gunwale connection 46, as well as the base foundation 34 connected to about the center of the watercraft 32 that will be detailed below. The deployment system 40 does not add to the mounting, but simply act as means to control the deployment of the deployable assembly 30.

I presently contemplate in all embodiments the foregoing joints, members, and pivot or moving joints to be made out of Schedule 40 PVC piping and fittings in several classes of diameters. However, they can have several different cross sections, such as oval, triangular, circular, etc., different sizes, different thickness and different materials, such as high carbon steel, aluminum and it's alloys, titanium, polycarbonate, etc.

With reference to FIG. 7, the base foundation 34 comprises of a base member 48A with a support 50 connected to thereof by a front first tee fitting 52A. A front first pin 54A is passed through holes defined in both base member 48A and the fitting 52A. This pin 54A resists member 48A from rotating inside fitting 52A. The support arm 50 is connected to a watercraft spine 56 by a foot 58 fastened down onto the spine 56.

The outrigger 36 is connected to the base foundation 34 by a second tee fitting 60 together with an end fitting 62 held in place by a second pin 64. The pin 64 passes through holes defined by the fitting 62 and member 48A. A 'D' shape configuration 66, joining the fittings 60 and 62 together, is rotate-able around the member 48A when the pin 64 is removed. The configuration 66, together as one unit with the member 48A, is also rotatable when the pin 54A is removed. With reference to FIG. 8, the configuration 66 comprises of a front vertical member 68A connecting to the fitting 62. A horizontal member 72 is connected to the member 68A by a 90 degree fitting 70A. Referring back to FIG. 7, angled member 74 is connected to horizontal member 72 by a first 45 degree fitting 78A. The fitting 60 is connected to the member 74 by a second 45 degree fitting 78B, finishing the D shape configuration 66. Both the members 72 and 74 are sized so that the fitting 60 is inboard enough to be attached to a gunwale 76 using the gunwale connection 46.

Figure 9:
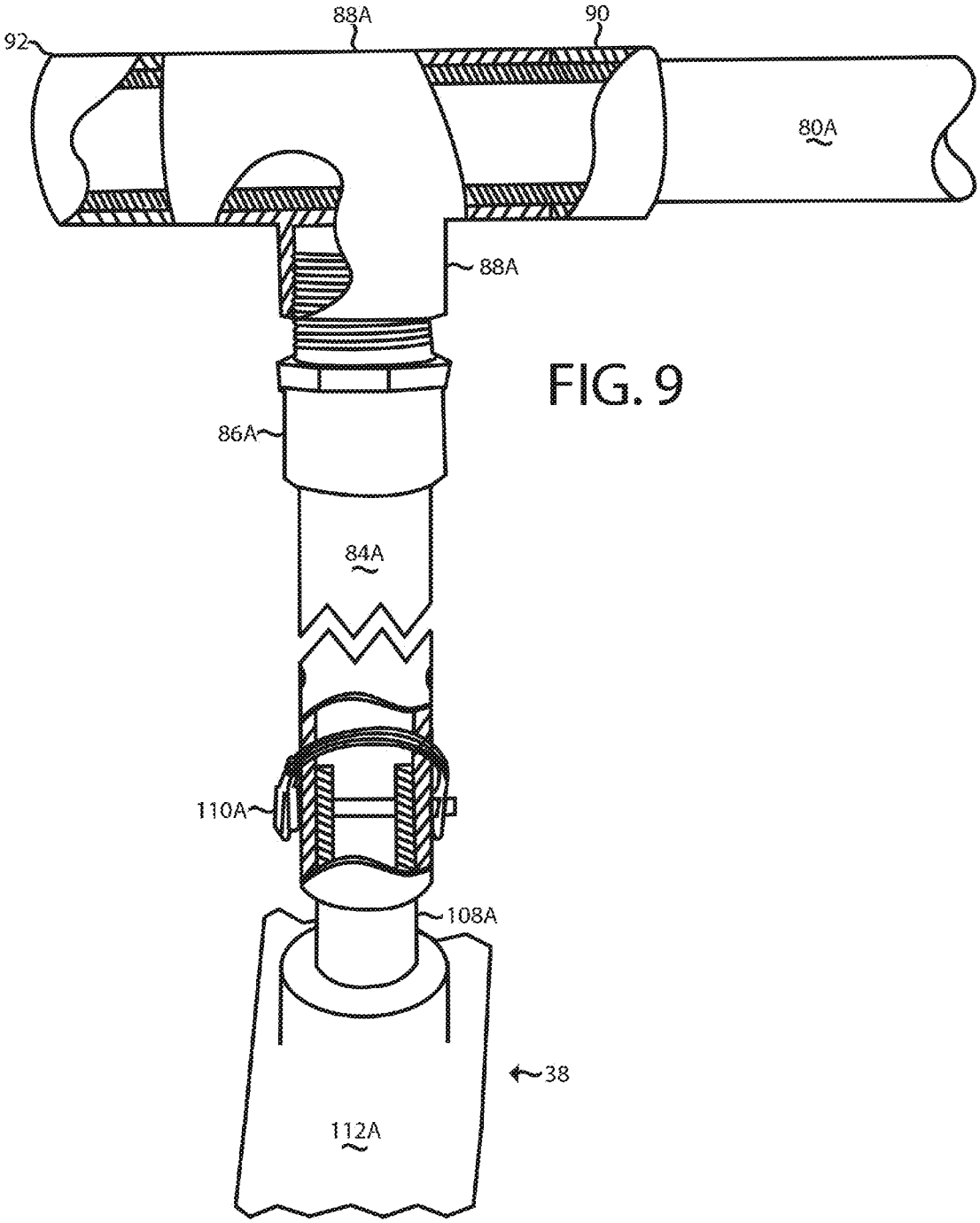
FIG. 9 shows a rear view of a vertical leg connection to an arm and to a pontoon.

With reference to FIGS. 7 and 8, the outrigger 36 also comprises of a front arm 80A connected to the vertical member 68A by an arm fitting 82 that freely rotates around member 68A. The fitting 82 is trapped from moving longitudinally along the member 68A by the fittings 62 and 70A. With reference to FIGS. 7 and 9, a front vertical leg 84A is connected to arm 80A by a threaded fitting 86A that threads into a front threaded tee fitting 88A. The fitting 88A freely rotates around a longitudinal axis of the arm 80A. The fitting 88A is constrained from traveling longitudinally along arm 80A by a fixed ring 90 and an end cap 92.

Figure 10:
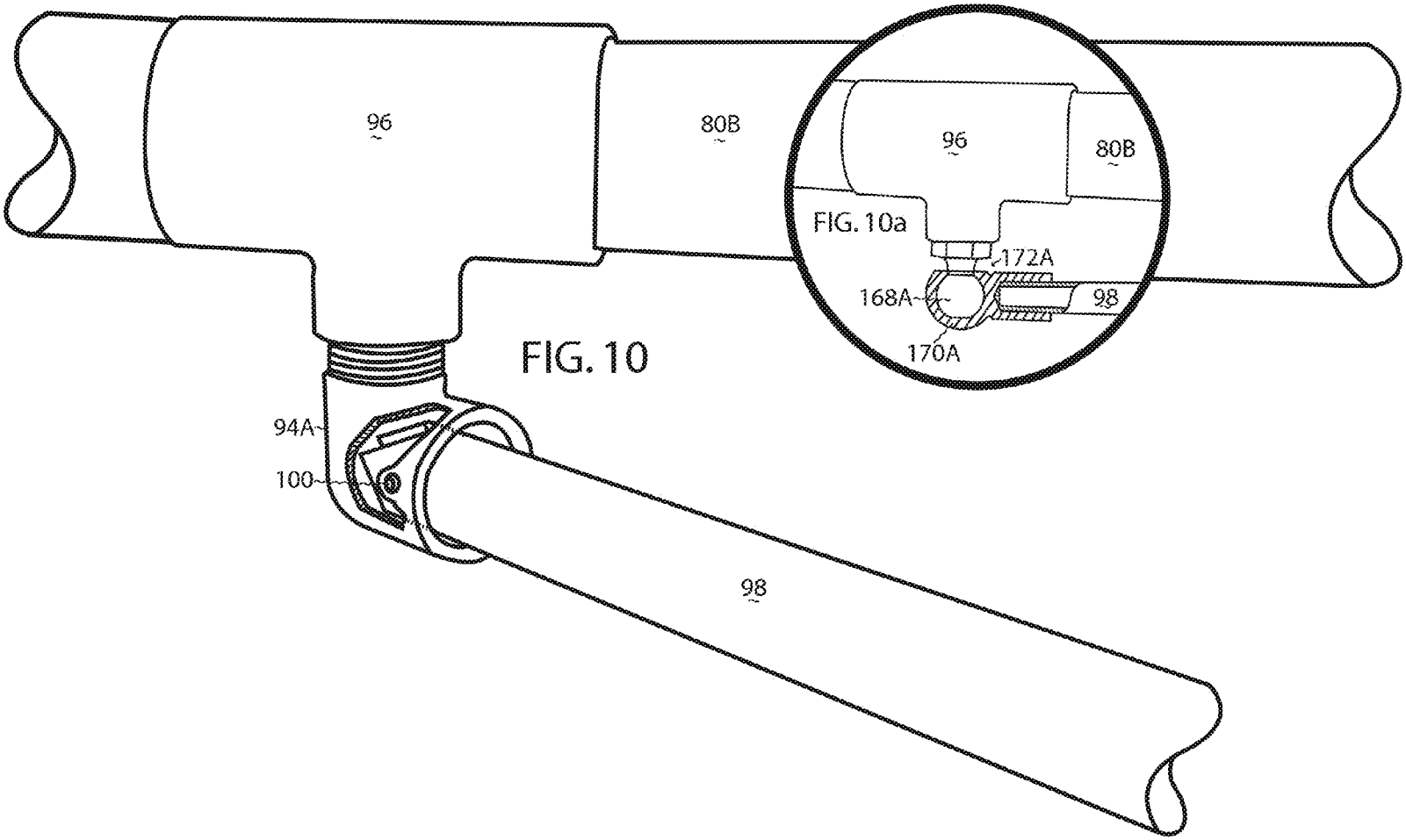
FIG. 10 shows an isometric rear view of an urging member attachment to arm.

With reference to FIG. 7, in the case of a single deploying device for solo means, i.e. a rear 44 setup, the fixed ring 90 is replace by the deployment system 40. With reference to FIG. 10, a rotating fitting 94A is connected to a rear arm 80B by threading into a threaded tee fitting 96 that replaces the ring 90. An urging member 98 is connected to the rotating fitting 94A by a tension pin 100 passing through oversized holes defined in the member 98. The pin 100 is secured in slip fit holes defined in the fitting 94A. With reference to FIG. 11, a housing 102 is connected to the member 98 by a second rotating fitting 94B threading into the housing 102. The fitting 94B connects to the member 98 in the same manner described above using tension pin 100.

The housing 102 slides over a gunwale 76 and holds it's position on gunwale 76 using a wingnut 104 threaded perpendicularly through the housing 102. The wingnut 104 sandwiches a shim 106 against the gunwale 76 under tension. This tension is a result of the counteracting force of a C shape in the housing 102 resisting a opening effect created by the wingnut 104 acting on gunwale 76.

Figure 12:
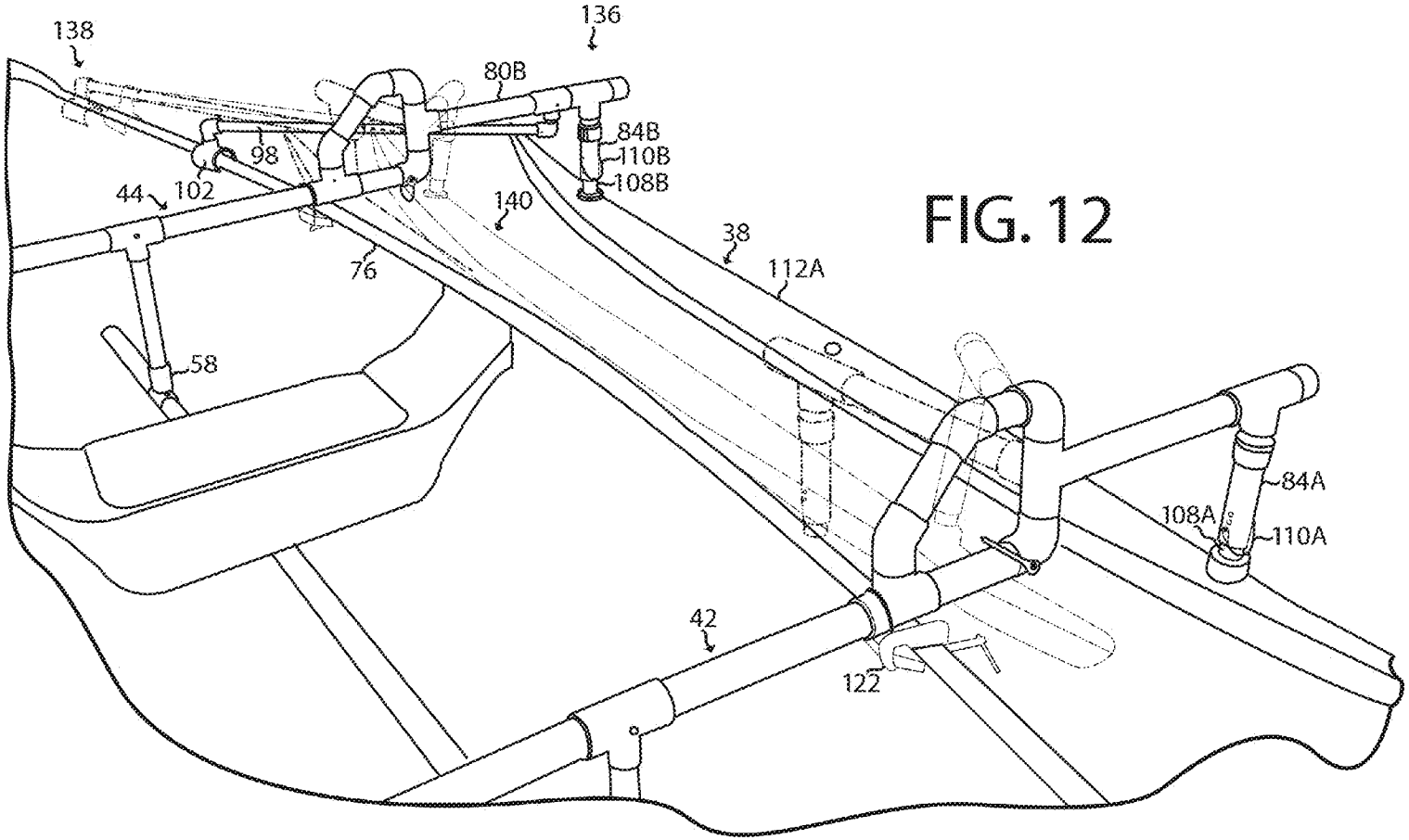
FIG. 12 shows a isometric side view of a lateral swing of embodiment from full deployment to a position adjacent to boat.

With reference to FIG. 7 but better shown in FIGS. 9 and 12, the front setup 42 is attached to the rear setup 44 by the suspended member 38. For the front setup 42, a front pontoon leg 108A projects from a pontoon 112A, and slides inside the leg 84A. The leg 108A is held in position by a front third pin 110A that passes through holes defined by both the legs 108A and 84A. At the rearward end 136 of the pontoon 112A, a second leg 108B projects from the pontoon 112A, and also slides inside a rear vertical leg 84B. Leg 108B is held in position inside leg 84B by a rear third pin 110B that passes through holes defined by both legs 108B and 84B.

With reference to FIG. 7 but better shown in FIG. 13, for a watercraft 32 with the gunwale 76, such as a canoe, both front 42 and rear 44 setup are attached to the watercraft by gunwale connection 46. A U shape bolt 114 passes over fitting 60, and passes into and attaches to a wood block 116 using two U bolt wingnuts 118 and spreader plate 120 (both 118 and 120 are not shown). The wood block 116 is shaped so as to conform to and hugs the underside of the gunwale 76, and is further held in place by a C clamp 122.

Figure 14:
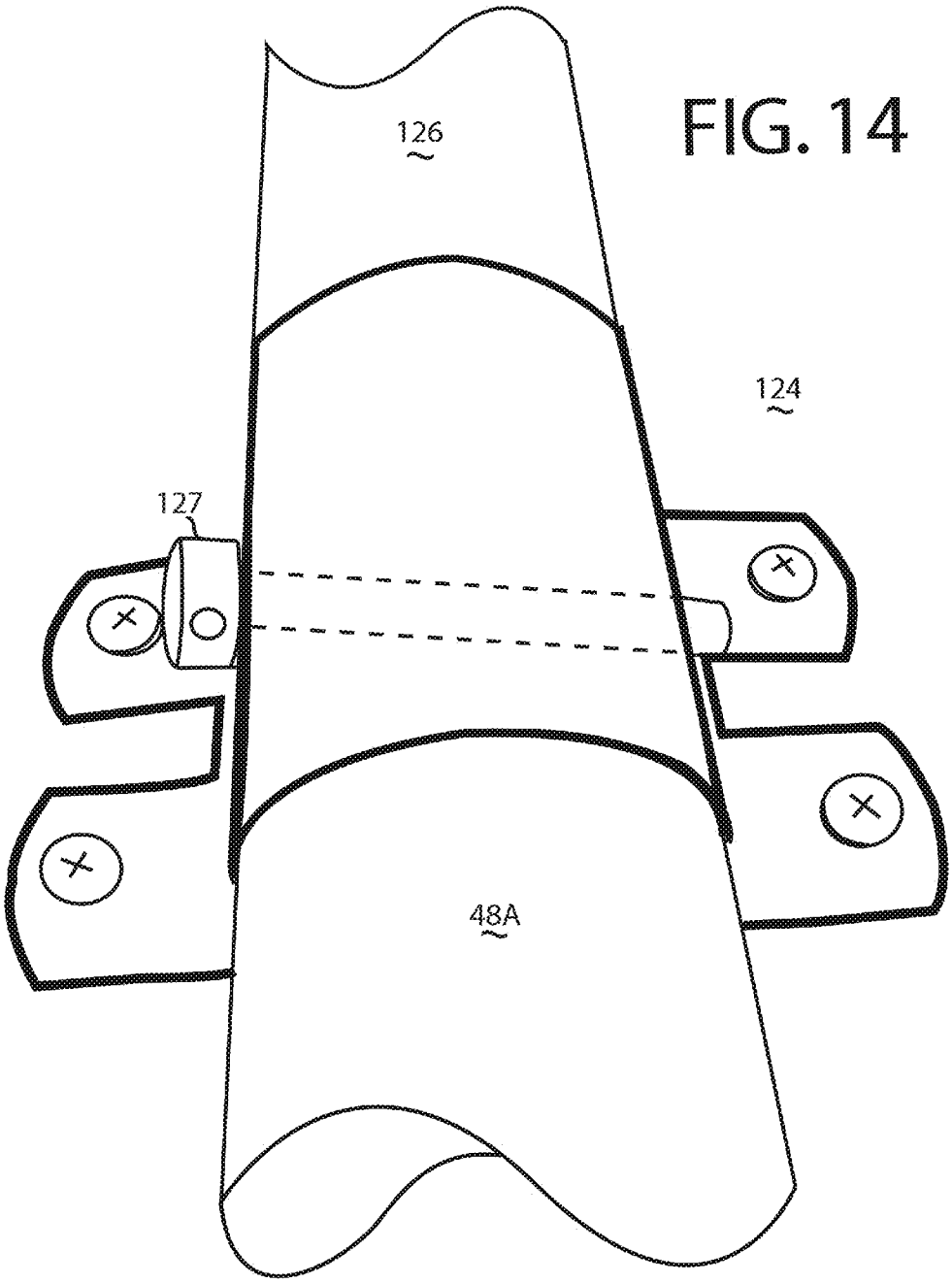
FIG. 14 shows a isometric side view of a deck attachment for base member.

With reference to FIG. 7, for a watercraft with a deck surface 124, such as a kayak, support arm 50 and first tee fitting 52A may be eliminated. Referring to FIG. 14, the base member 48A is attached to deck surface 124 with a clamp 126. The member 48A is prevented from moving by a pin 127 that passes through a pass through hole defined by the member 48A and the clamp 126.

This right side teaching is repeated for the left side of the figures, as the embodiment is symmetrically identical on both sides where applicable.

Operation

First Embodiment

FIGS. 6 to 18

Figure 15:
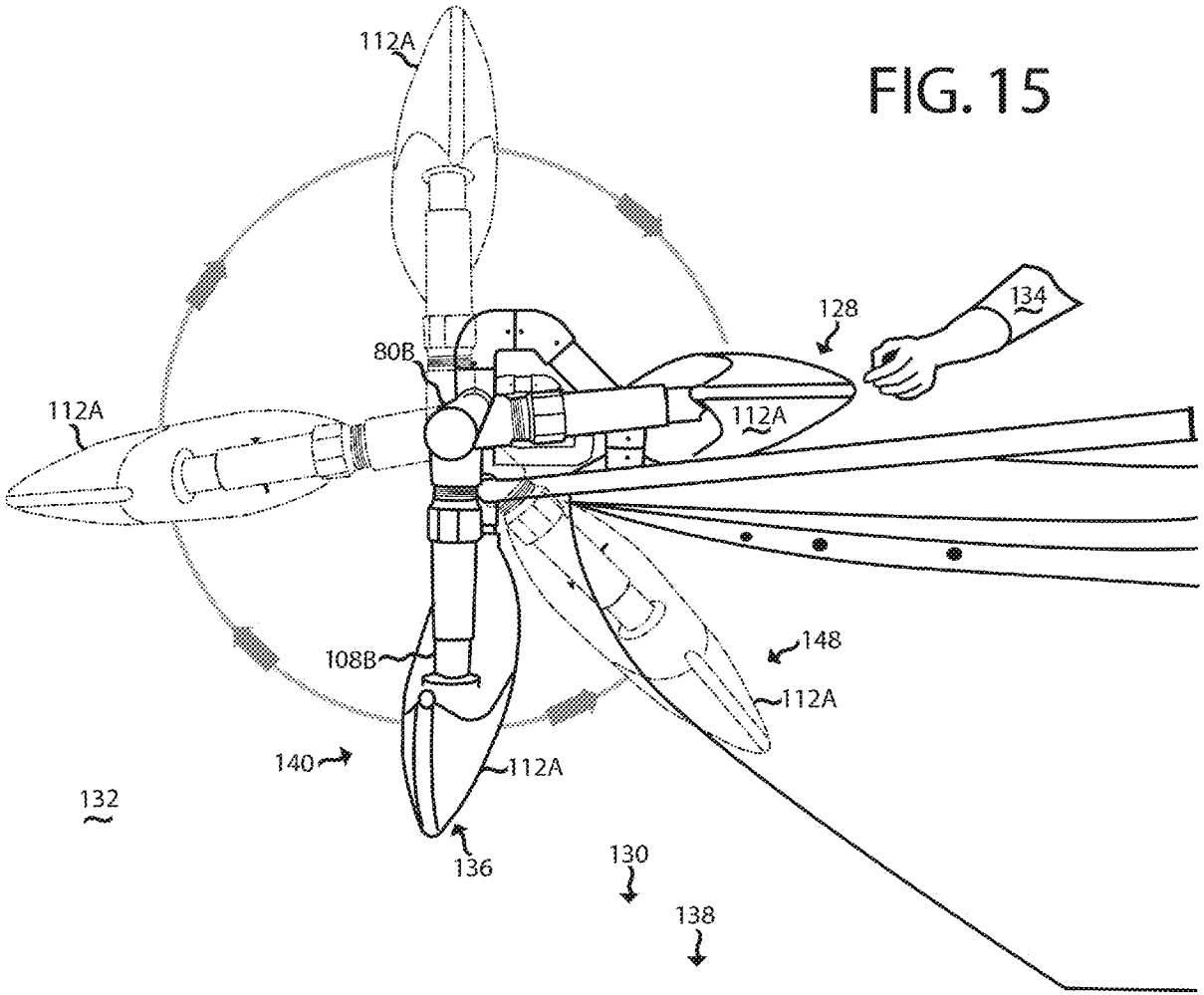
FIG. 15 shows a rear isometric view showing a flipping of pontoon into a watercraft, and pushing pontoon into watercraft for easy access.

The following teaching pertains to the right side of FIG. 6, or left side as seen from the rear in FIG. 15, and starts with an inside stowed position 128 in FIG. 6, and ending with a deployed position in FIG. 7. This teaching is duplicated to deploy the other side.

With reference to FIGS. 6 and 15, the deployable device is in an inside stowed position 128 with the pontoon 112A resting on top of a rear base member 48B. The first step is to deploy the pontoon 112A from the stowed position 128 to a position adjacent to watercraft 130 and touching a body of water 132 as better shown in FIG. 15. With reference to FIG. 15, an operator 134 reaches for the pontoon 112A, typically the nearest and rearward end 136. The operator 134 then lifts the pontoon 112A from the stowed position 128 to the position adjacent to watercraft 130 and touching the body of water 132. The pontoon 112A rotates around the arms 80A and B whose centerline forms a near straight line, a pivot line common for both pontoons legs 108A and B to rotate around thereof. Better shown in FIG. 15, thus, since the pontoon is in the most rearward but convenient to reach for position 138, the Operator 134 perform this rotation by solo means while staying in his vicinity previously constrained by operations of a stern mounted outboard motor. Additionally, this step also quickly engages the pontoon 112A onto the water 132, providing an immediate benefit of stabilization with a short and quick step.

With reference to FIG. 11, the housing 102 is enabled to slide over the gunwale 76 by first loosening up the wingnut 104 and retracting the shim 106 from housing 102. With reference also to FIG. 12, the housing 102 is then advanced forward along the gunwale 76, advancing the urging member 98 forward and outwards, pushing the arm 80B to rotate outwards around the member 68B better shown in FIG. 8. Better shown in FIGS. 10 and 11, the rotating fixtures 94A threaded to threaded tee fitting 96 accommodate for angular changes between urging member 98 and arms 80B respectively on a horizontal plane. This also applies for fixture 94B threaded into housing 102 for angle changes on the horizontal plane. As for the angle changes in the vertical plane, the extra space between the rotating fittings 94A and B and both ends of urging member 98, in conjunction with urging member 98 rocking freely around tension pin 100 housed by both fittings 94A and B, accommodate any angular changes on a vertical plane during the housing 102 advances.

With reference to FIG. 6 and in greater detail in FIG. 12, as the arms 80A and B swings or sweeps outwards laterally from watercraft 32, the pontoon 112A advances forwards and outwards somewhat parallel to the stowed position 128. During the swing, the vertical legs 84A and B, coupled to the threaded fitting 86A and B respectively, are forced to rotate inside the tee fitting 88A and B respectively, avoiding any binding. FIG. 9 illustrates such communication between the above parts to perform this non-binding arrangement for both front 42 and fear 44 setup, but only using the front setup 42 for exemplification purposes. With reference to FIG. 12, since pontoon 112A is a rigid body, the forward and outward motion generated in rear setup 44 actively transmits such motion to front setup 42 that follows suit in a passive way.

Housing 102 stops at a predetermined location on the gunwale 76 when the arms 80A and B have swung outwards enough to a predetermined position, usually when both arms 80A and B are in a near straight line with their respective base member 48A & B. This is the maximum deployment position as shown in FIG. 7. With reference to FIG. 11, the shim 106 is reinserted into sliding housing 102, just underneath the wingnut 104. The wingnut 104 is tightened down to hold the housing 102 static relative to the gunwale 76.

With reference to FIG. 9, the pontoon 112A height relative to the gunwale 76 (shown in FIG. 12) may be adjusted to a new preference. A lower pontoon 112A position into body of water 132 creates a faster response in counteracting any tipping. A higher pontoon 112A position slows down this response, but allows watercraft 32 to bank especially during sailing. This adjustment in position is accomplished by pulling the front third pin 110A out of holes defined by the pontoon leg 108A and the vertical leg 84A. Re-adjust the leg 108A inside the leg 84A to a new position that corresponds to one set of holes, out of the plurality of holes setups in both legs 108A and 84A, line up. Reengage the pin 110A into this lined up set of holes. Repeat this for rear setup 44 if needed.

With reference to FIGS. 11 and 12, in narrow river sections requiring a narrow watercraft width, the deployable assembly 30 included, simply loosen up the wingnut 104, remove the shim 106 from the housing 102, and slide the housing 102 back along the gunwale 76. Stop this sliding when the arm 80A has been swung sufficiently close to the watercraft 32 for a narrow profile 140. Reverse steps above to secure the housing 102 again to the gunwale 76, fixing this new narrow profile in place.

With reference to FIG. 15, an access in and out of the watercraft 32 is made easier when the pontoon 112A is pushed to thereof to a touching condition 148, starting with the pontoon 112 A at the rearward position 138. This position 148 allows a climbing person to move in as close to the gunwale as if no pontoon was present. It also eliminates any stepping over the pontoon 112A in inside stowed position 128 when this person steps into the watercraft 32. These benefits reduce the awkwardness of climbing into and of positioning within watercraft 32 and hence the risk of tipping.

This touching condition 148 is also beneficial when applied to a watercraft 32 with a deck surface 124, such as a kayak. Because the deck surface 124 of a kayak is often close to a paddler, there is limited room to have pontoon 112A in a stowage position 128 resting on deck 124 without interfering with paddle operation. Condition 148 solves this problem by letting pontoon 112A couple to watercraft 32 in a selectably releasable manner, lifting pontoon 112A high enough to no longer drag in water 132, but out of the way without impeding with paddle operation. I envision the selectable and releasable manner above to be performed with old and known art, such as a hook and ring feature, or a bungee loop on a hook feature, or any suitable variations. This feature that connects pontoon 112A to watercraft 32 is made separate or made integral to the connecting bodies. Another known art variation that uses less parts is a tongue and groove system. This system comprises of a pocket defined longitudinally on the side of watercraft 32 to receive the pontoon 112A. After this reception, a locking an upstanding tongue, coupled separately to or made integral with watercraft 32, catches on a matching groove defined in pontoon 112A. This catch locks in place, either temporarily or for a longer stowage period, when pontoon 112A attempts to swing away from position 148 to position 130 under gravity. Releasing the pontoon 112A simply involves lifting pontoon 112A so that it's groove clears the tongue and pontoon 112A is pushed away from watercraft 32 to a clearance position similar to position 130.

This teaching for operating this embodiment is repeated for the left side in FIG. 6, so that watercraft 32 is stabilized for both sides.

A reversal of this, teaching returns the deployable device's state back to the inside stowed position, 128.

Figure 16:
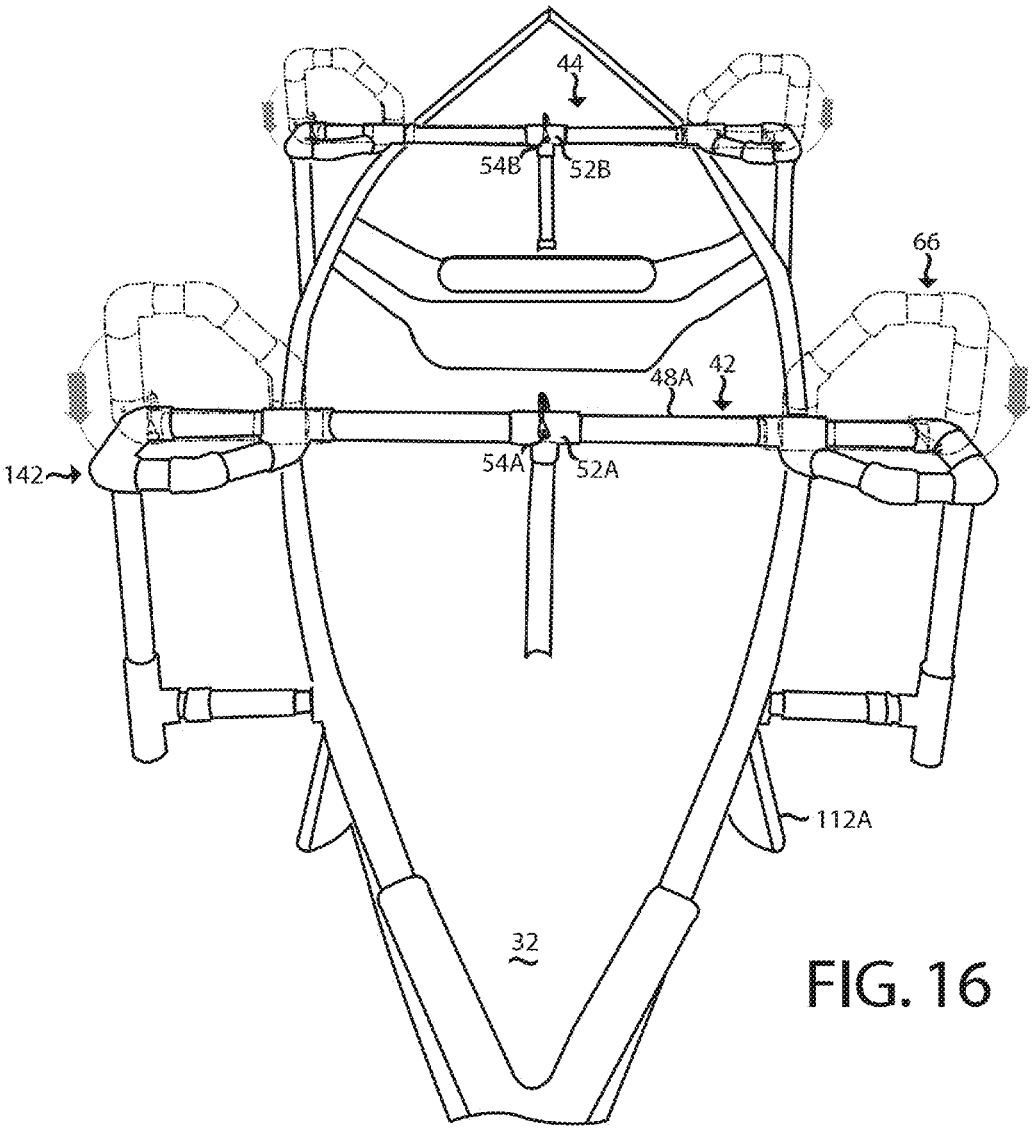
FIG. 16 shows a front isometric view of a Fold Flat state.
Figure 17:
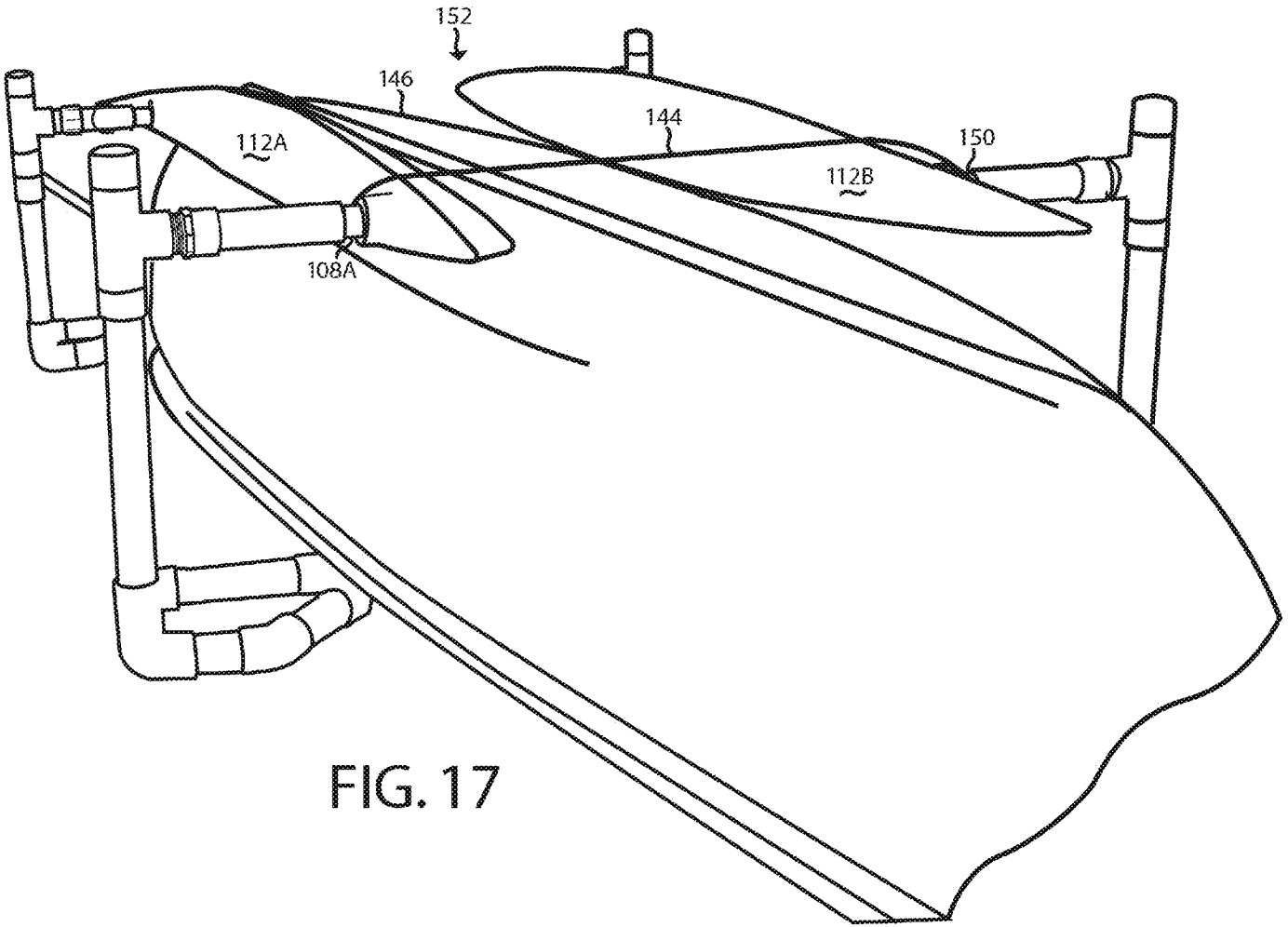
FIG. 17 shows a front isometric view of an upside down watercraft with pontoons being supported by under hull section.

With reference to FIG. 16, an alternate outside pontoon stowage position is shown that shows a Fold Flat state 142 that results in a much flatter gunwale to gunwale surface. This fold flat state 142 opens up the possibilities of car roof rack mounting, or transporting the watercraft 32 resting on a trailer bed on it's gunwales. With reference to FIG. 17, this state 142 is now possible as the pontoons 112A and B are out of the way and fully supported by other than the deployable assembly 30, in this case, the underside of watercraft 146. Additionally, this fold flat permits having two watercrafts with the openings facing each other but paired as such on one trailer, saving space and also a need for a second trailer.

With reference to FIG. 16, a fold flat stowage simply involves starting with the deployed position and removing the pin 54B from the fitting 52B for a single deployable assembly, or removing both the pins 54A and B for a dual deployable assembly, i.e. front 42 and rear 44 setups. The D shape configuration 66 is then rotated forward or backwards around the longitudinal axis of the base member 48A, keeping the pontoon 112A continuously adjacent to the watercraft 32. With reference to FIG. 17, a bungee cord 144 is then used to connect both the left and right pontoon legs, 108A and 150, to draw them closer to the side wall of the watercraft 32. This rests both pontoons 112A and B on the underside of the watercraft 146. Thus, this outside pontoon support arrangement 152, as well as the inside stowage arrangement 128 in FIG. 6, fully supports the weight of the elongated pontoon 112A and B. Both these stowage positions 128 and 152 also take out the need to design in trailer and stowage stress into the stabilization system, reducing cost, weight, bulk, and complexity of design over some prior-art stabilization systems.

Figure 18:
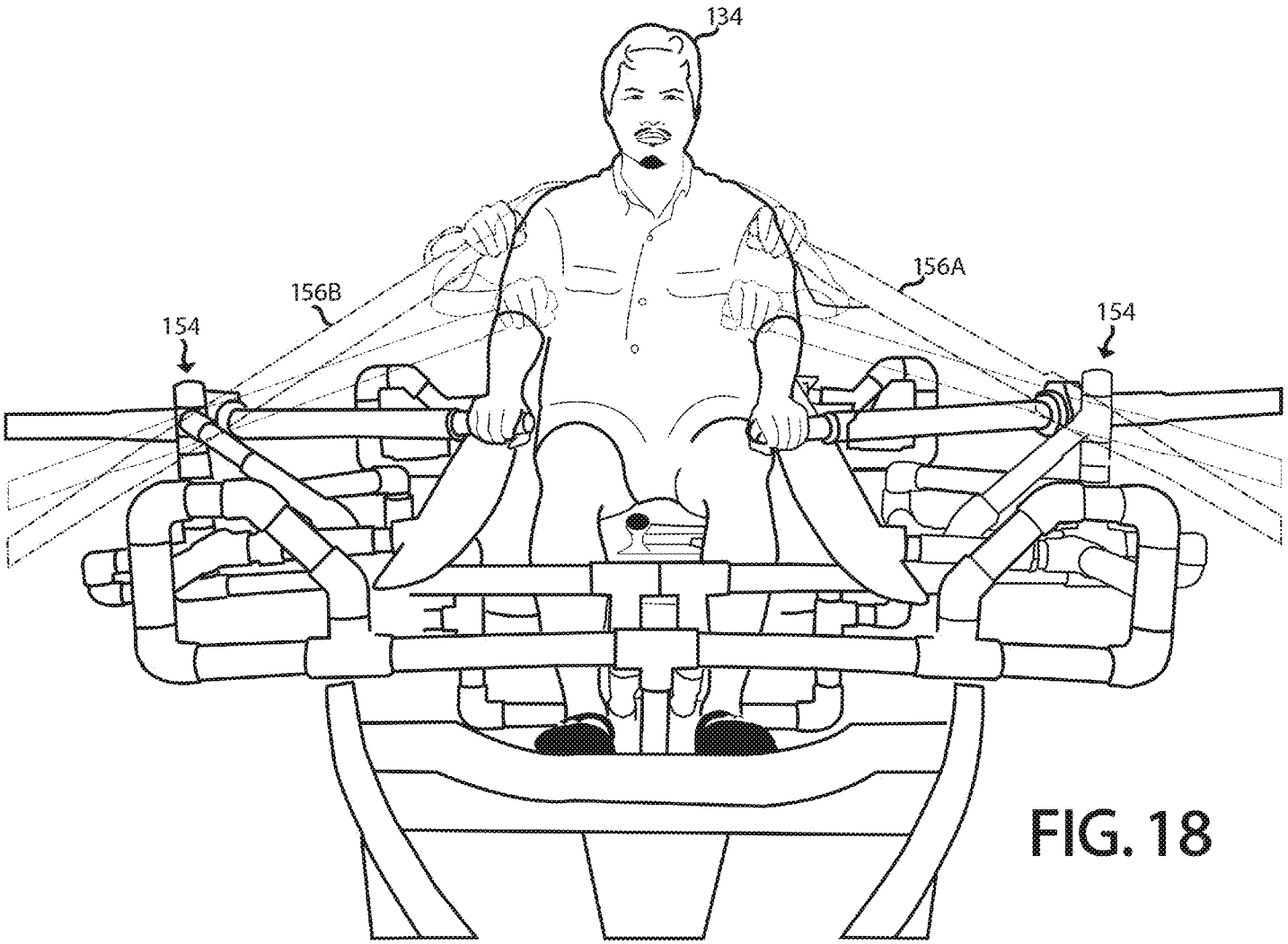
FIG. 18 shows a front isometric of a Rowing Rig, Operator, and extreme positions of oars and pontoons, with pontoons in stowage position.

With reference to FIG. 18, because of the compactness of the deployable assembly 30 in the stowage position 128, a rowing rig 154 can be used with thereof without interfering with oars 156A and B when rowing. The above arrangement maximizes watercraft 32 speed when rowing versus paddling, under minimum drag with pontoons 112A and B in stowage position 128, and without a need for extra stabilization since operator 134 is in a seated rowing position.

Description

Alternative Embodiment

FIGS. 8 to 20

Alternative Embodiment to Base Member 48A Connection to Arm 80A.

With reference to FIGS. 8A and B, several alternative embodiments joining arm 80A to base member 48A in a pivotal manner are illustrated. In FIG. 8A, a left hinge plate 158A is coupled to or made integral with the base member 48A. A right hinge plate 1588 is couple to or made integral with the arm 80A. Both plates 158A and B are pivotally connected by a hinge pin 160.

With reference to FIG. 8B, an outside yoke 162 is coupled to or made integral with the base member 48A. An inside yoke 164 is coupled to or made integral with the arm 80A. Both yokes 162 and 164 are pivotally connected by a yoke pin 166.

Alternative Embodiment to Connecting Urging Member 98 to Arm 80B

With reference to FIG. 10A, the urging member 98 is alternatively connected, with or without fitting 96, to the arm 80B by a front ball stud 168A and a front socket end 170A that forms a front ball and socket joint 172A. This joint connects the urging member 98 to the arm 80B that allows angle changes resulting from the housing 102 sliding on the gunwale 76, a movement better seen in FIG. 12. The end 170A may be coupled to or made integral with the urging member 98. The ball stud 168B may be coupled to or made integral with the arm 80B.

Alternative Embodiment to Connecting Urging Member 98 to Arm 80B

With reference to FIG. 11A, the urging member 98 is alternatively connected to the housing 102 by a rear ball stud 168B and a rear socket end 170B. This rear ball and socket joint 172B connects the urging member 98 to the housing 102 that allows wide angle changes resulting from the housing 102 sliding on the gunwale 76, a movement better seen in FIG. 12. The end 170B may be coupled to or made integral with the urging member 98. The ball stud 168B may be coupled to or made integral with the housing 102. The socket end 170B is releasable and re-engageable with the stud 168B when desired.

Alternative Embodiment to Gunwale Connection 46 Connecting Water Deployable Assembly 30 to Gunwale 76.

With reference to FIG. 13A, the embodiment in FIG. 13 can be made a permanent fitting by replacing the clamp 122 with a gunwale bolt 174 passing through a hole define by a vertical gunwale wall 178. The bolt 174 also passes through a hole defined in the block 116, and is secured by a nut 176.

With reference to FIG. 20, a more consolidated approach is shown in a second base member 48C, eliminating the need for the base member 48A, the support arm 50, the fitting 52A, the pin 54A, and the D configuration 66. This alternative embodiment comprises of a U shaped clip 180 and a clamp screw 182 that engages perpendicularly to the interior side 184 of the clip 180. The screw 182 engages a pressure plate 186 and an attached non slip material 188A onto the wall 178. This reactively urges an exterior side 190 of the clip 180 towards the wall 178. An exterior pressure plate 192 is removably attached to this exterior side 190 using a keyed feature 194 integral to the plate 192. This feature 194 communicates in a releasably locking manner with a key hole feature 196 defined in the exterior side 190 of the clip 180. The pressure plate 192 and an exterior non-slip material 188B is pushed into the wall 178 by the side 190, effectively selectively locking this embodiment onto the gunwale 76. The keyed feature 194 in the hole 196, in corporation with the screw 182 releasably holding pressure plate 186, makes both plates 186 and 192 removable, allowing the U clip to be removably attached to gunwale 76.

An inside yoke 164 is coupled, either as separately or made integral with, to the side 190. An outside yoke 162 is pivotally connected to the inside yoke 164 by a yoke pin 166. The outside yoke 162 carries the arm 80A in a manner allowing the arm 80A to revolve along it's longitudinal axis. The arm 80A connects, either as separately or made integral with, to a swivel stud 198 that coactively engages within a pocket 200. Pocket 200 is coupled, either as separately or made integral with, to yoke 162.

Another variation not requiring illustration here is to simply replace Yoke arrangement with Hinge arrangement illustrated in FIG. 8A. A side to side comparison between FIGS. 8A and B clearly identifies interchange-ability between elements in both figures.

With additional reference to FIG. 19, the alternate base member 48C also further eliminates the arm 80A, allowing a direct connection of the stud 198 to an arm portion 206 of a second vertical leg 202. Leg 202 also comprises of an integrated down standing leg 204 that connects pivotally to a suspended member with a recess 208. This effectively reduces the total number of parts needed to rotate member 208 in the manner illustrated in FIG. 15.

Alternative Embodiment to Vertical Leg 84A Connection to Arm 80A.

With reference to FIGS. 19 and 20, the embodiment in FIG. 19 having a revolving connection outside of a pivoting connection allows a new second vertical leg 202 that is better shown in FIG. 19 referenced hereon. The member 202 comprises of an down standing leg 204 now integral to an arm portion 206, eliminating the many pieces connecting the arm 80A to the pontoon 112A as illustrated in FIG. 9. With reference to FIG. 19A, however, a suspended device 208 with a recess 210 and a cap 212 fastened onto the device 208 is needed to accommodate any rotational angle changes in a horizontal plane between the device 208 and the leg 204 during deployment. The leg 204 has a raised ring feature 214 coupled, as a separate piece or made integral with, to thereof. The cap 212 has an inner diameter 216 that is smaller than outside diameter of the ring 214, keeping the leg 204 in the recess 210. The down standing leg 204 may be telescopic to provide more vertical adjustments to the suspended device 208.

Alternative Embodiment to Arm 80A Connection to a Second Vertical Leg 202.

First alternative: The above leg 202 may be connected to arm 80A using several different embodiments. With reference to FIG. 19B, the arm 80A has an outside threaded end 216 that is threaded to an inside threaded end 218 of arm portion 206 of the leg 202. During the rotation of the suspended device 208 in the manner shown in FIG. 15, the member 80A remains stationary, while the portion 206 rotates around thereof. Because the allowable aggregate rotation is less than one full turn in either direction, the fore and aft travel of the device 208 is insignificant and does not cause any binding, nor will it cause both members 80A and 206 to thread and de-couple completely if they both had been installed properly beforehand.

Second alternative: With reference to FIG. 19B', the arm 80A with outside threads 216 is again present. However, the portion 206 slips inside the arm 80A until a second raised ring feature 220, a feature coupled to member 206 either separately or made integral with, prevents further entry. A threaded housing 222 is installed onto the end 216, preventing the member 206 from sliding out of the member 80A but yet letting thereof rotate freely. During the rotation of the suspended device 208 in the manner shown in FIG. 15, the member 80A remains stationary, while member 206 rotates around thereof.

Third alternative: With reference to FIG. 19B", the portion 206 is sized to slip over arm 80A to a predetermined overlap distance, an overlap held longitudinally together by a threaded member 224. The member 224 is threaded into a first spreader nut 226 that spreads and grabs the inside walls of the member 206, as better seen in FIG. 19C. And inside arm 80A, the member 224 is threaded into a second spreader nut 228. A plurality of blocking devices 230 may be installed in a non-moving way, two on each end, such as welding a nut onto member 224. As an example, nut 226 has blocking devices directly in front or behind it to force member 224 to rotate with portion 206. Nut 228 has blocking devices spaced apart to allow the member 224 to thread up and down longitudinally to correspond with all rotations in FIG. 15. This blocking device spacing can be reversed, such blocking the left side but spacing the right side of member 224. Another arrangement is to evenly split this distance between both ends of member 224. Also, a further reduction of parts may be achieved if nut 226 is welded onto member 224, eliminating any blocking devices 230 requirements for that end.

With reference to embodiments in FIGS. 19B, 19B', and 19B", fitting 96 has to be either relocate longitudinally inward of section 19B and attach itself in a fixed way, or it would have to allow the portion 206 to rotate freely inside it. The threaded housing 222 offers the possibility of integrating ball stud 172A as means to provide a ball and socket connection 172A. This connection 172A connects urging member 98 to portion 206, yet allowing portion 206 to freely rotate along its own longitudinal axis.

CONCLUSIONS, RAMIFICATIONS, AND SCOPE

From the description above, a number of advantages of some embodiments of my deployable device become evident:

1. A pontoon system that sweeps inward laterally, bringing the pontoons 112A & B closer to an operator constrained to the stern area, allows the operator to more quickly manipulate the pontoons position between a stowed and a deployed position prior to fishing-while-standing conditions, or when moving around in the watercraft.
2. The use of a deployment system 40 that tracks on the gunwale provides a easy, convenient, and fast method of deploying a pontoon system by solo means from the back of the watercraft.
3. The use of an arm 80A and B pivoting near the gunwale, as well as providing a rotating axis for pontoon to be stowed inside, no longer has the constraint of having to be short enough to allow an occupant to comfortably sit in between the pontoons. This then removes the constraint on the stabilizing properties, as the resistance to roll is directly proportional to arm 80A and B length.

4. Additionally, the above mentioned use of arm 80A and B in (3) allows a lowered pontoon stowed position that does not impede with the operations of any accessories, such as a rowing rig that makes it possible to row rather than to paddle the canoe without drag from pontoons.
5. That the above mentioned use of arm 80A in (3) also allows the pontoon to be completely out of the way, without substantially adding to the canoe frontal profile.
6. The use of a front 42 and a rear 44 setup overcomes the twisting nature of canoes, making the stabilization more responsive by employing a long enough pontoon system that places the two attachment points closer to each stress points.
7. The use of a rotate-able base member 48A, with a D shape configuration 66 to assist this rotation, allows a relatively flat gunwale surface to mount on top of a car roof top carrier.
8. The use of a front 42 and rear 44 setup allows more buoyant but elongated pontoon for increased buoyancy without dramatically increasing stowage. Because of the longer longitudinal property, the increased cross section profile of new pontoon can still remain small enough to readily stow inside the watercraft side walls.
9. The above mentioned use of arm 80A in (3) together with housing 102 allow a rapid change in the watercraft's total width, stabilization included, that is operable from the rear of the boat and by solo means without having to move around.
10. The above mentioned use of arm 80A in (3) can more readily maintain the benefit of the pontoons remaining in continuous contact with the water, even under a reduced stabilization, while traveling under a narrow river width that necessitates extra stabilization.
11. The rotation of pontoon around arm 80A and B allows a safer and easier access in and out of watercraft during the climb over the gunwale 76. This step in clearance is made smaller with a simple rotation of pontoon 112A that brings it in contact 148 with watercraft 32, bringing climbing person closer to gunwale 76.
12. The rotation of pontoon around arm 80A and B creates an intermediate stowage position that clears the pontoon 112A from the water for kayaks, and not encroach into paddler's operational space.
13. The above mentioned use of arm 80A in (3) results in configurations that directly supports the weight of an elongated pontoon outside or on the inside of watercraft without having to detach it from the deployable assembly. In addition to saving setup and breakdown time, this also reduces the need to design in the associated stress from trailering or stowing into the stabilization system. This then reduces cost, weight, bulk, and complexity of design.

Ramifications: Although the embodiments show connections (such as 90 degree fitting 70) connecting non moving members together, these members can be coupled together by other methods such as welding, epoxy gluing, wrapping, etc. This eliminates the connections themselves, reducing the assembly complexity (less elements), reducing the weight, as well as cost. Additionally, a connection can be made integral to a member communicating with it in static way when couple together. An example of integration is injection molding the 90-degree fitting 70 onto horizontal member 72. Additionally, the fitting can be wholly eliminated if a member can be bent in the same shape as outlined by an assembly of members and connections, such as making D shape configuration 66 with one member.

The arm 80A rotation around the vertical member 68A can be constrained by a pair of overlapping blocks. These blocks attached, either integrally or made separately, to fittings 82 and fitting 70 (or fitting 62) constrain the arm 80A rotation around front vertical member 68A. This will prevent the arm 80A from swinging past and inside a longitudinal line running through arms 80A and B in both front setup 42 and rear setup 44, creating a binding condition. This will facilitate a rapid swinging up pontoon 112A from an adjacent to watercraft position 130 to inside stowed position 128 as illustrated in FIG. 15.

Any alternative embodiment that no longer relies on a D shape configuration 66 joining base member 48A to arm 80A (FIGS. 8A and B) would now require an alternate assistance in achieving the fold flat state 142. A rotate-able lever (not shown) can be rotate-ably connected at one end to base member 48A. This lever is shaped to conform to base member 48A when not in use, but may swing out perpendicularly from base member 48A to assist with rotating base member 48A.

An annular groove locking into an annular locking ring can further simplify all rotational connections, such as tee fitting 88A connection to arm 80A. An example would be fitting 88A having an annular locking groove defined on the inside diameter side that locks into an annular locking ring connected, by separate or integral means, to arm 80A. This then would eliminate fixed ring 90 and end cap 92, reducing part complexity and cost. Similarly, fitting 88A may have an annular ring defined on the side that locks into an annular locking ring integral or coupled to threaded fitting 86A. As mentioned above, a further reduction of parts is accomplished when fitting 86A, now with a annular locking ring feature, is now coupled separately to or integrated with vertical leg 84A. This scenario is repeated for other similar joints requiring rotational movement to further reduce complexity of parts.

Additionally, screws may be added to further secure coupled parts that are non-moving when coupled together.

Additionally, pontoons may be replaced with watercraft hulls, so that the system is now a multi-hull embodiment.

Additionally, base member 48A and B can be a 'U' or 'V' shaped support, or any shape with a dip inside the watercraft 32. This change allows pontoons 112A&B to stow further below the horizontal surface defined from gunwale to gunwale.

Additionally, the arm 80A &B may swing forward past the longitudinal axis of base member 48A. This would allow the pontoons to take a narrow profile, but rather now stored into the boat in a forward bias way, rather than the rear bias way described in the teachings of operation. This is particularly useful to free up more room in the rear or to gain more access to the adjacent surrounding body of water.

Additionally, the front 42 and rear 44 setup can be flip-flopped to having housing 102 activated from front of boat.

Additionally, two rear 44 setups can used so that deployable device is deployable from both ends of the watercraft. Additional means to communicate both housing 102 on each end is needed so that one releases before the other urges forward.

Additionally, an alternative manual version of connecting housing 102 to a fixed pivot lever moves the housing 102 back and forth by changing the lever's pivot angle. A dual lever system, one for each side, is also possible and can be reduced to a single lever system if housings 102 from both sides are connected together to be driven simultaneously by the same one lever.

Additionally, housing 102 may be power actuated by connecting to a reciprocating armature that is electrically powered and controlled.

Additionally, the use of urging member 98, housing 102, and all the needed connections to attach them to gunwale 76 and arm 80B, can be completely eliminated if a servo motor or a like changes the angle between arms 80A &B and base members 48A and B. And that this proposed device either has a locking means, or is strong enough to keep this angle near constant when pontoon is in deployed use.

While the above description contains many specificities, these should not be construed as limitations on the scope of any embodiments, but as illustrations of various embodiments thereof. Many other ramifications and variations are possible with the teachings of the various embodiments. For example, the deployable assembly 30 can be mounted on any body of interest, for instance, to a tractor that has nozzles sprays along a pipe in lieu of pontoon 112A to dispense chemicals, adjusting laterally for differing separation distances between rows of plants. Another example would be pontoon 112A might be substituted with skis or a means to stabilize on snow, ice, or mud, or any other environment. Another example may be even replacing pontoon 112A with weights to reduce watercraft tipping and to slow it down in a current. Another example would be providing means to extend a deck that supports weight, such as attaching a waterproof flexible material between the arms 80A and B of front 42 and rear 44 setup. Another example would be providing a means to cover a boat during storage or even providing boat occupants a means to protect them from the environment. This requires connecting the corners of a collapsible waterproof material to vertical legs 84A and B, on both sides, and having thereof extending upwards from deck.

Accordingly, the scope should be determined not by the embodiments illustrated, but by the appended claims and their legal equivalents.

The invention claimed is:

1. A deployable assembly, comprising:

a base member removably attachable to a watercraft;

a leg of a predetermined cross sectional shape and length having a longitudinal axis, a first end and a second end, wherein the first end is configured to be revolvably carried by, and pivotally connected to, the base member, allowing the leg to rotate around the longitudinal axis at the first end;

a suspended member of a predetermined cross sectional shape, length, and outside shape, configured to revolvably connect to the second end of the leg, wherein the suspended member is rotatable to a first position above the watercraft, and wherein the suspended member is rotatable to a second position placing the suspended member adjacent to or in contact with a first wall of the watercraft, the first wall being an inside wall of the watercraft or an outside wall of the watercraft, the inside wall side being the same side as the side the base member is attached to the watercraft; and a selectively actuatable housing having a first end and a second end, wherein:

the first end of the selectively actuatable housing is configured to connect to the leg at a predetermined position along the longitudinal axis of the leg, further wherein the first end of the selectively actuatable housing is configured to urge the leg to swing laterally outwards from or inwards to the watercraft, and the second end portion of the housing is configured to selectively engage with the watercraft in order to connect the leg with the watercraft.

2. The deployable assembly in claim 1, wherein:

the second end of the leg is bent at a right angle from the first end of the leg; and the second end of the leg has a raised ring surface coupled thereto.

3. The deployable assembly in claim 1, further comprising:

a raised ring surface coupled to the second end of the leg; and a recess on the suspended member, wherein the recess comprises a cap configured to pivotally trap the leg inside the recess.

4. The deployable assembly of claim 1, further comprising:

an arm having a predetermined cross sectional shape and length having a first end and a second end, wherein:

the first end of the arm connects pivotally to the base member; and the second end revolvably connects to the leg, allowing the leg to rotate around a longitudinal axis of the arm.

5. The deployable assembly of claim 1, wherein the base member comprises:

a connection separably clampable in an embracing engagement over a gunwale of the watercraft, connecting the base member to the watercraft in a removably attachable manner.

6. The deployable assembly of claim 1, wherein:

the base member has a predetermined cross sectional shape, and is of sufficient length to be supported longitudinally by a gunwale of the watercraft.

7. The deployable assembly of claim 6, further comprising:

a connection separably clampable in an embracing engagement over a gunwale of the watercraft, connecting the base member to the watercraft in a removably attachable manner.

8. The deployable assembly of claim 7, further comprising:

a support arm comprising a first end portion and a second end portion, wherein:

the first end portion of the support arm is connected to the base member in an arrangement that allows the base member to rotate around a predetermined axis, and the second end portion of the support arm is connected to the example watercraft.

9. The deployable assembly of claim 1, wherein a single human can deploy the deployable assembly without having to move about the watercraft, further wherein the deployable assembly stabilizes the watercraft when the deployable assembly is deployed.

10. The deployable assembly of claim 1, further comprising a plurality of pivots to connect the housing to the leg.

11. The deployable assembly of claim 10, further comprising:

an urging member having a first end portion and a second end portion;

a first pivot connecting the first end portion of the urging member to the leg; and a second pivot connecting the second end portion of the urging member to the housing.

12. A watercraft comprising:

a watercraft body;

a first deployable assembly connected with the watercraft body on a first side of the watercraft body, the first deployable assembly comprising:

a base member attached to the watercraft body;

a leg of a predetermined cross sectional shape and length having a longitudinal axis, a first end and a second end, wherein the first end is revolvably carried by, and pivotally connected to, the base member, allowing the leg to rotate around the longitudinal axis at the first end;

a suspended member of a predetermined cross sectional shape, length, and outside shape, revolvably connected to the second end of the leg, wherein the suspended member is rotatable to a first position above the watercraft body, and wherein the suspended member is rotatable to a second position placing the suspended member adjacent to or in contact with a first wall of the watercraft body, the first wall being an inside wall of the watercraft body or an outside wall of the watercraft body, the inside wall side being the same side as the side the base member is attached to the watercraft body; and a selectively actuatable housing having a first end and a second end, wherein:

the first end of the selectively actuatable housing is connected to the leg at a predetermined position along the longitudinal axis of the leg, further wherein the first end of the selectively actuatable housing is configured to urge the leg to swing laterally outwards from or inwards to the watercraft, and the second end portion of the housing is configured to selectively engage with the watercraft body in order to connect the leg with the watercraft body.

13. The watercraft of claim 12, wherein a single human can deploy the first deployable assembly without having to move about the watercraft, further wherein the first deployable assembly stabilizes the watercraft when the deployable assembly is deployed.

14. The watercraft of claim 12, wherein:

the second end of the leg is bent at a right angle from the first end of the leg; and the second end of the leg has a raised ring surface coupled thereto.

15. The watercraft of claim 12, wherein the first deployable assembly further comprises:

a raised ring surface coupled to the second end of the leg; and a recess on the suspended member, wherein the recess comprises a cap configured to pivotally trap the leg inside the recess.

16. The watercraft of claim 12, wherein the first deployable assembly further comprises:

an arm having a predetermined cross sectional shape and length having a first end and a second end, wherein:

the first end of the arm connects pivotally to the base member; and the second end revolvably connects to the leg, allowing the leg to rotate around a longitudinal axis of the arm.

17. The watercraft of claim 12, wherein the first deployable assembly further comprises:

a connection separably clampable in an embracing engagement over a gunwale of the watercraft body, connecting the base member to the watercraft body.

18. The watercraft of claim 12, further comprising:

a second deployable assembly connected with the watercraft body on a second side of the watercraft body opposite the first side of the watercraft body, the second deployable assembly comprising:

a second base member attached to the watercraft body;

a second leg of a predetermined cross sectional shape and length having a longitudinal axis, a first end and a second end, wherein the first end is revolvably carried by, and pivotally connected to, the second base member, allowing the second leg to rotate around the longitudinal axis at the first end;

a second suspended member of a predetermined cross sectional shape, length, and outside shape, revolvably connected to the second end of the second leg, wherein the second suspended member is rotatable to a first prime position above the watercraft body, and wherein the second suspended member is rotatable to a second prime position placing the second suspended member adjacent to or in contact with a first prime wall of the watercraft body, the first prime wall being an inside wall of the watercraft body or an outside wall of the watercraft body, the inside wall side being the same side as the side the base member is attached to the watercraft body; and a selectively actuatable second housing having a first end and a second end, wherein:

the first end of the selectively actuatable second housing is connected to the second leg at a predetermined position along the longitudinal axis of the second leg, further wherein the first end of the selectively actuatable second housing is configured to urge the second leg to swing laterally outwards from or inwards to the watercraft, and the second end portion of the second housing is configured to selectively engage with the watercraft body in order to connect the second leg with the watercraft body.

19. The watercraft of claim 18, wherein the watercraft body is symmetrical and the second deployable assembly is a reflection of the first watercraft assembly.

20. The watercraft of claim 18, wherein a single human can deploy the first deployable assembly and the second deployable assembly without having to move about the watercraft body, further wherein the first deployable assembly and the second deployable assembly stabilize the watercraft when the first deployable assembly and the second deployable assembly are deployed.

* * * * *